US007683016B2

(12) United States Patent
King et al.

(10) Patent No.: US 7,683,016 B2
(45) Date of Patent: Mar. 23, 2010

(54) SOY-BASED METHYL ESTER HIGH PERFORMANCE METAL WORKING FLUIDS

(75) Inventors: James P. King, Lansdale, PA (US); Neil M. Canter, Willow Grove, PA (US)

(73) Assignee: United Soybean Board, St. Louis, MO (US)

( * ) Notice: Subject to any disclaimer, the term of this patent is extended or adjusted under 35 U.S.C. 154(b) by 1057 days.

(21) Appl. No.: 10/486,493

(22) PCT Filed: Aug. 13, 2002

(86) PCT No.: PCT/US02/25512

§ 371 (c)(1),
(2), (4) Date: Feb. 11, 2004

(87) PCT Pub. No.: WO03/080771

PCT Pub. Date: Oct. 2, 2003

(65) Prior Publication Data

US 2004/0248744 A1 Dec. 9, 2004

Related U.S. Application Data

(63) Continuation of application No. PCT/US02/25512, filed on Aug. 13, 2002.

(60) Provisional application No. 60/311,848, filed on Aug. 14, 2001.

(51) Int. Cl.

| | |
|---|---|
| ***C10M 137/04*** | (2006.01) |
| ***C10M 105/34*** | (2006.01) |
| ***C10M 141/10*** | (2006.01) |
| ***C10M 169/04*** | (2006.01) |

(52) U.S. Cl. ..... 508/459; 508/437; 508/441; 508/421; 508/443

(58) Field of Classification Search ..... 508/437, 508/491, 459, 421, 441, 443
See application file for complete search history.

(56) References Cited

U.S. PATENT DOCUMENTS

| | | | | |
|---|---|---|---|---|
| 2,882,228 | A | 4/1959 | Watson et al. | |
| 3,791,975 | A | 2/1974 | Halkias | |
| 3,963,692 | A | 6/1976 | Ivey, Jr. | |
| 4,132,662 | A | 1/1979 | Sturwold | |
| 4,134,845 | A | 1/1979 | Wakim | |
| 4,138,348 | A | 2/1979 | Grasshoff | |
| 4,149,982 | A | 4/1979 | Lee et al. | |
| 4,152,278 | A | 5/1979 | Bell | |
| 4,225,456 | A | 9/1980 | Schmidt et al. | |
| 4,359,393 | A | 11/1982 | Sturwold | |
| 4,374,168 | A * | 2/1983 | Wojtowicz | 428/212 |
| 4,466,909 | A | 8/1984 | Stayner | |
| 4,612,127 | A | 9/1986 | Uematsu et al. | |
| 4,637,885 | A | 1/1987 | Kuwamoto et al. | |
| 4,769,178 | A * | 9/1988 | Kenmochi et al. | 508/493 |
| 4,844,830 | A | 7/1989 | Budd et al. | |
| 4,885,104 | A * | 12/1989 | Sturwold | 508/344 |
| 4,923,625 | A | 5/1990 | King | |
| 4,948,521 | A | 8/1990 | Stewart, Jr. et al. | |
| 5,126,064 | A | 6/1992 | Barber et al. | |
| 5,236,606 | A | 8/1993 | Rangel | |
| 5,241,003 | A | 8/1993 | Degonia et al. | |
| 5,275,749 | A * | 1/1994 | Kugel et al. | 508/375 |
| 5,320,764 | A | 6/1994 | Camenzind et al. | |
| 5,338,471 | A * | 8/1994 | Lal | 508/186 |
| 5,507,961 | A | 4/1996 | Forster et al. | |
| 5,552,068 | A | 9/1996 | Griffith | |
| 5,573,696 | A | 11/1996 | Hughes et al. | |
| 5,618,779 | A | 4/1997 | Klein et al. | |
| 5,627,147 | A | 5/1997 | Hayakawa et al. | |
| 5,641,734 | A | 6/1997 | Naegely | |
| 5,652,201 | A | 7/1997 | Papay et al. | |
| 5,688,749 | A | 11/1997 | Ibuki et al. | |
| 5,710,112 | A | 1/1998 | Yaegashi et al. | |
| 5,716,917 | A | 2/1998 | Williams et al. | |
| 5,721,199 | A | 2/1998 | Moses | |
| 5,736,493 | A | 4/1998 | Garmier | |
| 5,773,636 | A | 6/1998 | Demmering et al. | |
| 5,780,397 | A | 7/1998 | Landis et al. | |
| 5,780,400 | A | 7/1998 | MacNeil et al. | |

(Continued)

FOREIGN PATENT DOCUMENTS

| | | |
|---|---|---|
| JP | 57-073088 | 5/1982 |
| JP | 59-227986 | 12/1984 |
| JP | 61-213296 | 9/1986 |

OTHER PUBLICATIONS

J.A. O'Brien, "Lubricating Oil Additives", CRC Handbook of Lubrication, vol. II, pp. 301-315.

William C. Gergel, "Lubricant Additive Chemistry", 1984- The Lubrizol Corporation, pp. 1-21.

Soy Methyl Ester Solvents Technical Background, 2 pages.

http://www.westerndynamics.comDownload/kinviscliquids.pdf for kinematic viscosities of vegetable oils (cited in a Sep. 25, 2006 Office Action from U.S. Appl. No. 10/486,494).

Internet Archive Elco Corporation Metalworking additives, Elco 670. <web.archive.org/web/2001063010514/www.elcocorp.com/products/Elco670.html> retrieved from the web on Apr. 9, 2007.

*Primary Examiner*—Glenn Caldarola
*Assistant Examiner*—Jim Goloboy
(74) *Attorney, Agent, or Firm*—Venable LLP; Michael A. Gollin; Thomas F. Barry

(57) ABSTRACT

The inventive composition comprises compatible combinations of methyl esters of fatty acids or triglycerides and polar non-chlorine extreme pressure additives, the composition being either (a) a working strength straight oil, (b) a soluble oil concentrate dilutable to a working strength soluble oil, the composition when at working strength effectively lubricating metal parts during high performance metalworking, and providing environmental and safety advantages.

40 Claims, 4 Drawing Sheets

U.S. PATENT DOCUMENTS 5,792,731 A * 8/1998 Ichihashi et al. ..... 508/322
5,858,934 A 1/1999 Wiggins et al.
5,863,872 A 1/1999 Garmier
5,877,131 A 3/1999 Barnes
5,908,816 A 6/1999 Kobessho et al.
5,916,854 A 6/1999 Inaya et al.
5,939,366 A 8/1999 MacNeil et al.
5,958,849 A 9/1999 Hewson et al.
5,985,806 A 11/1999 O'Lenick, Jr.
5,990,055 A 11/1999 Garmier
5,994,279 A 11/1999 Felsky et al.
6,004,914 A 12/1999 Perella et al.
6,010,985 A 1/2000 Heimann et al.
6,028,038 A 2/2000 Kusch
6,051,538 A 4/2000 Majerczak
6,063,741 A 5/2000 Naitoh et al.
6,096,699 A 8/2000 Bergemann et al.
6,127,326 A 10/2000 Dieckmann et al.
6,127,560 A 10/2000 Stidham et al.
6,204,225 B1 * 3/2001 Lightcap, Jr. ..... 508/178
6,291,409 B1 * 9/2001 Kodali et al. ..... 508/491
2001/0056045 A1 * 12/2001 Lal ..... 508/491
2002/0016266 A1 2/2002 Fletschinger et al.

* cited by examiner

SOY-BASED METHYL ESTER HIGH PERFORMANCE METAL WORKING FLUIDS

This application claims the benefit of provisional application U.S. Ser. No. 60/311,848, filed Aug. 14, 2001, incorporates herein by reference.

BACKGROUND OF THE INVENTION

This invention relates to a high performance metalworking fluid that has lubricating and extreme pressure/anti-wear properties and is environmentally safe, biodegradable, and non-hazardous, comprising a methyl ester of fatty acids or triglycerides component combined with a polar non-chlorine extreme pressure additive.

Soybean oil and vegetable oil triglycerides are heterogeneous products and may be converted to esters by a variety of processes, e.g. Demmering et al., U.S. Pat. No. 5,773,636 and Stidham et al., U.S. Pat. No. 6,127,560. Chlorinated methyl esters of soybean oils are known from Kusch, U.S. Pat. No. 6,028,038. A methyl soyate cleaning agent is described in Opre et al., U.S. Pat. No. 6,096,699. Oil lubricating additives are also known, e.g. O'Brien, J. A., *Lubricating Oil Additives*, Handbook of Lubrication, p. 301-315, Vol. II, Edited by E. Richard Booser, CRC Press, Inc., 1984; Gergel, W. C., *Lubricant Additive Chemistry*, The International Symposium Technical Organic Additives and Environment, Interlaken, Switzerland, May 24-25, 1984, The Lubrizol Corporation. Biodegradable triglyceride-based lubricants are described in e.g. Stewart et al., U.S. Pat. No. 4,948,521 and Naegely, U.S. Pat. No. 5,641,734. Soluble oil metalworking fluids based on soybean oil are described in Lightcap, U.S. Pat. No. 6,204,225. Also known are metalworking compositions with chlorine-free extreme pressure agents, e.g. U.S. Pat. No. 5,908,816.

Most traditional metalworking fluids are based on mineral oils that present potential environmental hazards. These formulations have been widely used for about thirty years. The most difficult metalworking applications (such as fine-blanking heavy gauge carbon steels, broaching, and drawing of stainless steel tubes and wires) require high performance metalworking fluids containing chlorinated paraffins. Recently however, the use of chlorinated paraffins has been questioned due to hazards to workers and the environment. The corrosiveness of chlorinated paraffins' decomposition products, primarily hydrogen chloride, is a concern. A more serious problem is presented at incineration facilities where incineration temperatures are not high enough, producing highly toxic and cancer-causing waste products. Previous attempts to use non-chlorinated replacements have failed in metalworking requiring high performance lubricating and extreme pressure/anti-wear properties.

There is a need for a high performance, economical, environmentally safe metalworking fluid. There is a growing need for effective, biodegradable soy-based straight oil and soluble oil metalworking fluids. For example, Section 9002 of the 2002 Farm Bill mandates federal procurement of biobased products. However, no existing preparations have been able to effectively replace chlorine-containing mineral oil-based metalworking fluids.

SUMMARY OF THE INVENTION

The inventive composition provides novel mixtures of methyl esters of fatty acids or triglycerides and polar non-chlorine extreme pressure additives, the composition being either (a) a working strength straight oil, (b) a soluble oil concentrate dilutable to a working strength soluble oil, or (c) a soluble oil diluted to working strength with a diluent, the composition when at working strength effectively lubricating metal parts during metalworking.

The inventive composition is environmentally responsible, biodegradable, non-hazardous, and provides a high performance metalworking fluid with lubricating properties and anti-wear/extreme pressure properties. This invention provides a surprisingly effective combination of a methyl ester of fatty acids or triglycerides, such as methyl soyate, and a highly polar non-chlorine extreme pressure additive that provides lubricating performance comparable to mineral oil/chlorinated paraffins-based metalworking fluids.

The composition may require a thickener for high viscosity, such as blown seed oils, blown fats, telemers derived from triglycerides, high molecular weight complex esters, polyalkymethacrylates, polymethacrylate copolymers, styrene-butadiene rubber, malan-styrene copolymers, polyisobutylene, and ethylene-propylene copolymers. For stability, the composition may also require a coupling agent or surfactants, such as polyethylene glycol esters, glyceryl oleates, sorbitan oleates, and fatty alkanol amides. To reduce varnish, gum and sludge formation, addition of antioxidants and dispersants, such as hindered phenols, aromatic amines and succinimides may be required. For soluble oil formulations, which may further include water, mineral oil or solubilizing agents, the composition may also require anti-bacterial and anti-fungal compounds to increase bioresistance. The inventive compositions have good residency time, film strength, load carrying capacity, and good compatibility of the components (methyl soyate/polar non-chlorine extreme pressure additive system plus optional thickeners etc.).

The present invention relates to a composition comprising: a methyl ester of fatty acid and a polar non-chlorine extreme pressure additive, the composition being either (a) a working strength straight oil, (b) a soluble oil concentrate dilutable to a working strength soluble oil, or (c) a soluble oil diluted to working strength with a diluent, the composition when at working strength effectively lubricating metal parts during metalworking and providing environmental and safety advantages. In one embodiment of the invention, there is no mineral oil or added water.

This composition, at working strength, effectively lubricates metal parts under conditions of high temperature, high load, high torque, high friction and/or high speed. It can be a high performance fluid with lubricating properties in a four-ball EP LWI test of at least about 130, and extreme anti-wear/extreme pressure properties of a four-ball EP weld point of at least about 620 kg. The composition can also impart a four-ball EP weld point of at least about 800 kg. In addition, it can be lubricious at Falex EP (ASTM D3233) of at least about 4500 lbs. and over.

The methyl ester of a fatty acid is a $C_5$-$C_{22}$ methyl ester of a fatty acid derived from triglyceride of vegetable oil or animal fats. In one embodiment of the invention, the methyl ester of a fatty acid can be a methyl ester of an oil selected from the group consisting of methyl ester of soybean oil, lard, tallow, coconut oil, rapeseed (canola) oil, peanut oil, crambe oil, sunflower oil and combinations. In another embodiment, the methyl ester of a fatty acid can also be a methyl ester of soybean oil. In addition, the methyl ester of fatty acid can be a methyl ester of palmitic acid, stearic acid, oleic acid, linoleic acid and linolenic acid. The methyl ester of triglyceride can be SoyGold 6000 or SoyGold 1000.

In one aspect of the invention, the polar non-chlorine extreme pressure additive is a sulfur- or phosphorus-based derivative. The polar non-chlorine extreme pressure additive is selected from the group consisting of amine phosphates, propanolamine phosphates, butylamine phosphates, phosphate esters, organophosphites, sulfurized fatty esters, sulfurized hydrocarbons, sulfurized triglycerides, polysulfides, long chain alkyl amine phosphates, allylamines or alkanolamine salts of phosphoric acid, and combinations. In another aspect, the polar non-chlorine extreme pressure additive is selected from the group consisting of Desilube 77, RheinChemie RC 8000 and RheinChemie RC2540, RheinChemie 2515, RheinChemie 2526, Lubrizol 5340L, Nonyl Polysulfide, Vanlube 672, Rhodia Lubrhophos LL-550, or EICO 670.

In another embodiment of the invention, the composition can further comprise a thickener. A preferred viscosity can be at 40° C. is at least about 30 cSt. This thickener can be selected from the group consisting of blown seed oils, blown fats, telemers derived from triglycerides, high molecular weight complex esters, polymeric ester, blown castor oil, polyalkymethacrylates, polymethacrylate copolymers, styrene butadiene rubber, ester-styrene copolymers, polyisobutylene, ethylene-propylene copolymers and combinations. The thickener can also be G.Pfau Blown Castor Oil Z8, Inolex GC5000, Roh-Max Viscoplex 8-702, Lubrizol 7785 or Lubrizol 3702. This thickener permits the composition to have residency time as expressed by kinematic viscosity of at least about 100 cSt at 40° C., film strength as measured by four-ball initial seizure load of at least about 120 kg, load carrying capacity as measured by four-ball load wear index of at least about 130, and compatibility between the methyl ester of triglyceride and the polar non-chlorine extreme pressure additive.

In yet another embodiment of the invention, the composition further comprises a stabilizing coupling agent and/or surfactant. The coupling agent and/or surfactant is selected from the group consisting of propylene glycol, polyethylene glycol esters, glyceryl oleates, glyceryl monooleate, sorbitan oleates, fatty alkanol amides and combinations. In one aspect of the invention, the working strength straight oil composition may further comprise a detergent (surfactant). In yet a further aspect, the composition further comprises an antioxidant and/or dispersant. The antioxidant and/or dispersant is selected from the group consisting of hindered phenols, aromatic amines, succinimides and combinations. The antioxidant and/or dispersant can also be selected from the group consisting of Lubrizol 7652 by Lubrizol Corporation, Irganox L109 or Irganox L57 by Ciba Corporation. The dispersant can be HiTec 646 by Ethyl Corporation.

In one aspect of the invention, the composition comprising from about 20% to about 95% methyl soyate, from about 5% to about 25% polar non-chlorine extreme pressure additive, up to about 50% thickener, up to about 10% coupling agent and/or surfactant, and up to about 25% antioxidant and/or dispersant. In another aspect, the composition comprising from about 45% to about 90% methyl ester, about 5% to about 15% polar non-chlorine extreme pressure additive, and about 5% to about 7.5% glyceryl monooleate. The ratio of the methyl ester of fatty acid to the polar non-chlorine extreme pressure additive can be from about 50:1 to about 1:2.

This invention further relates to a method of using a composition of the invention for lubricating purposes comprising applying the composition to metal parts during metalworking.

Yet a further embodiment of this invention also relates to a composition being concentrated soluble oil. The composition can comprise from about 5% to about 90% methyl ester of fatty acid, about 3% to about 20% polar non-chlorine extreme pressure additive, and up to about 10% water.

The composition can comprise from about 5% to about 90% methyl ester of a fatty acid, about 1% to about 20% polar non-chlorine extreme pressure additive, about 10% to about 50% emulsifiers, up to about 10% antioxidants, about 1% to about 10% biocides, about 5% to about 40% corrosion inhibitors, up to about 10% coupling agents, up to about 10% defoamers, up to about 10% water and up to about 90% mineral oil. In one aspect of this embodiment, the methyl ester is a methyl soyate.

The ratio of the methyl ester to the polar non-chlorine extreme pressure additive can be from about 1:2 to about 50:1. The ratio of the methyl ester of fatty acid to the polar non-chlorine extreme pressure additive can also be from about 30:1 to about 2:1.

This embodiment can further comprise up to about 90% mineral oil. In this aspect of the invention, the composition can comprise from about 5% to about 90% methyl ester, about 20% to about 35% polar non-chlorine extreme pressure additive, and about 5% to about 90% mineral oil. The composition can further comprise from about 5% to about 90% triglyceride or methyl ester of a triglyceride, about 1% to about 20% polar non-chlorine extreme pressure additive, about 10% to about 50% emulsifiers, up to about 10% antioxidants, about 1% to about 10% biocides, about 5% to about 40% corrosion inhibitors, up to about 10% coupling agents, up to about 10% defoamers, up to about 10% water and up to about 90% mineral oil.

In yet a further aspect, the composition is a mixture of the methyl ester of fatty acid, the polar non-chlorine extreme pressure additive and mineral oil in a ratio of about 1:2:6. It can also comprise mixture of the methyl ester, the polar non-chlorine extreme pressure additive and mineral oil in a ratio about of 9:1:0.

In yet a further aspect, the composition comprises an antibacterial and/or anti-fungal compound effective to prevent bacterial and fungal formation. The composition can be from about 5% to about 90% methyl ester, about 3% to about 20% polar non-chlorine extreme pressure additive, up to about 10% water, up to about 10% coupling agents, 5% to 40% corrosion inhibitors, up to about 10% biocides, about 10% to 50% emulsifiers, up to about 6% antioxidants and up to about 5% defoamers.

In yet another embodiment, the invention relates to a method of malting a soluble oil composition, comprising: (a) combining a methyl ester of fatty acid with an extreme pressure non-chlorinated additive to form a soluble oil concentrate, and (b) diluting the concentrate to working strength with water. This can further comprise adding a coupling agent for increasing stability, a corrosion inhibitor, an emulsifier, an anti-bacterial and/or anti-fungal compound effective to reduce bacterial and fungal formation.

The soluble oil of this invention can comprise at least about 50%, 75% or 95% of a diluent. The diluent can be water. The soluble oil can comprise from about 5% to about 50% methyl ester, and about 5% to about 20% polar non-chlorine extreme pressure additive, the ratio of methyl ester to polar non-chlorine extreme pressure additive being in the range of about 1:1 up to about 50:1, preferably up to about 20:1 or up to about 10:1.

This oil can further comprise a soluble oil conditioner selected from a group consisting of a coupling agent for increasing stability, a corrosion inhibitor, an emulsifier, an anti-bacterial, anti-fungal compound, and combinations. The composition can comprise from about 5% to about 90% methyl ester ester, about 3% to about 20% polar non-chlorine extreme pressure additive, about 10% to about 50% emulsifiers, up to about 10% antioxidants, about 1% to about 10% biocides, about 5% to about 40% corrosion inhibitors, up to about 10% coupling agents, up to about 10% defoamers, up to about 10% water and up to about 90% mineral oil.

The invention provides a metalworking fluid for lubricating a metal surface, comprising: a base fluid compound having polar end groups and non-polar hydrocarbon chains (C5-C22) and a boiling point in the range of about 200° to about 300° C., and a polar non-chlorine extreme pressure additive, during metalworking, the base fluid compound lubricating the metal surface at temperatures below the boiling point, and removing heat away from the metal surface at the boiling point, the extreme pressure additive increasing in concentration, and reacting chemically with the metal surface as the temperature exceeds the boiling point of the base fluid, the metalworking fluid effectively lubricating the metal surface during metalworking so as to prevent failure at temperatures below, at, and above the boiling point of the base fluid.

The inventive compositions have metalworking performance at least equivalent to a mineral oil based chlorinated paraffin metalworking fluid.

In all such compositions, the methyl ester of a fatty acid is preferably methyl soyate.

Further objectives and advantages will become apparent from a consideration of the description, drawings, and examples.

BRIEF DESCRIPTION OF THE DRAWINGS

The invention is better understood by reading the following detailed description with reference to the accompanying figures, in which like references refer to like elements throughout, and in which.

DETAILED DESCRIPTION OF THE PREFERRED EMBODIMENTS

Figure 1:
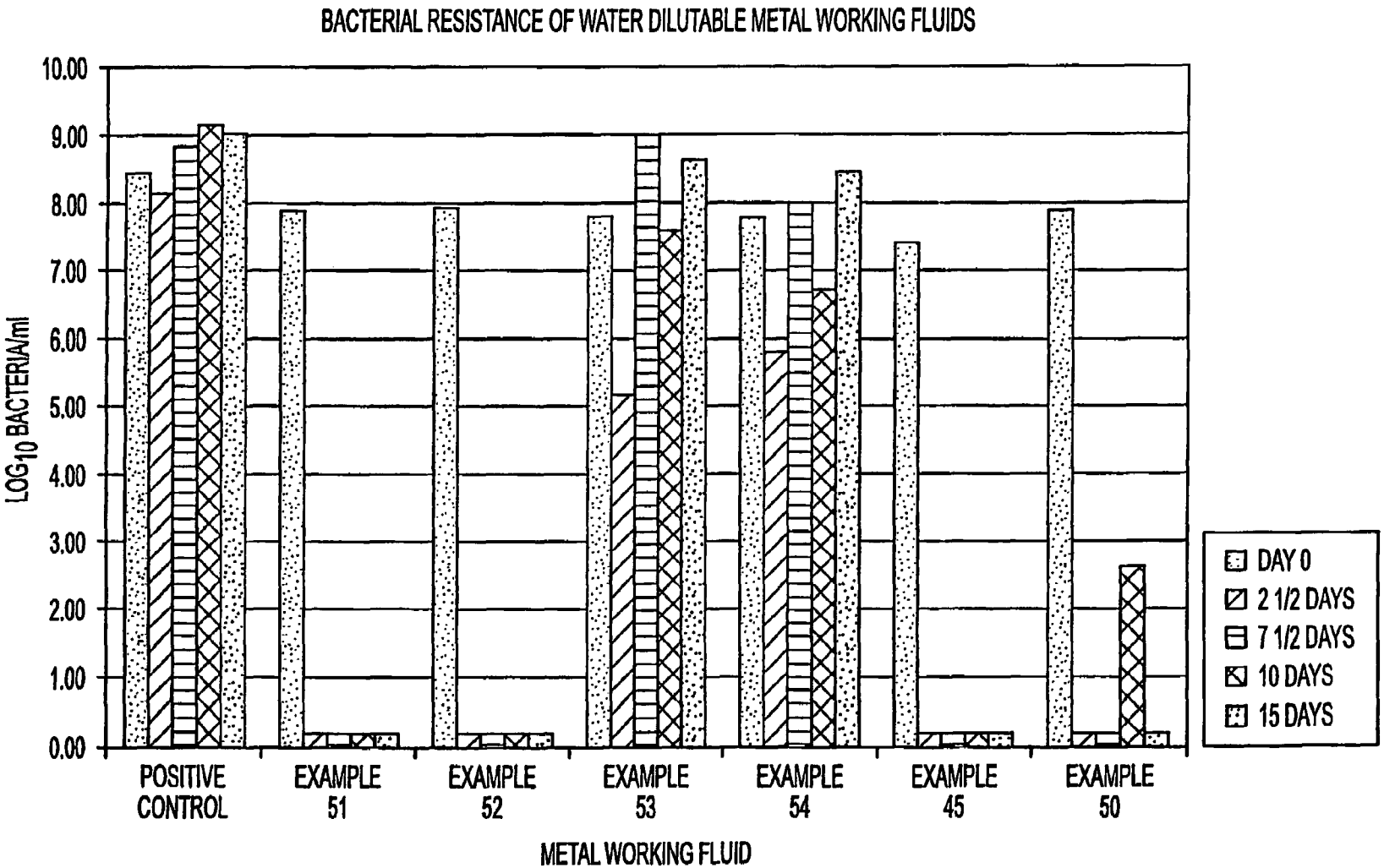
FIG. 1 demonstrates the bacterial resistance of water diluted metal working fluids, specifically for Examples 50, 51, 52, 53, 54 and 45. For each example, the first column represents 0 days, the second column represents 2.5 days, the third column represents 7.5 days, the fourth column represents 10 days, and the fifth column represents 15 days.

In describing preferred embodiments of the present invention, specific terminology is employed for the sake of clarity. However, the invention is not intended to be limited to the specific terminology so selected. It is to be understood that each specific element includes all technical equivalents, which operate in a similar manner to accomplish a similar purpose. Each reference cited here is incorporated by reference as if each were individually incorporated by reference.

The invention provides fluids based on natural oils such as soybean oil, for heavy-duty metalworking applications. Preferred compositions based on methyl esters of a fatty acid combined with a polar non-chlorine extreme pressure (EP) additive have unique characteristics. The combination exhibits outstanding extreme pressure/anti-wear properties that are far superior to existing mineral oil-based counterparts. Inventive compositions containing a methyl ester of fatty acids or triglycerides and a polar non-chlorine extreme pressure additive combination successfully replaced chlorinated paraffin-mineral oil-based fluids containing up to about 15%, 35% and even 55% chlorine in real world field trials of fine-blanking operations. The synergistic effect produced by methyl soyate and a polar non-chlorine extreme pressure additive is capable of filling the gap in the lubrication regime in which a chlorine-containing EP additive is generally required.

Generally, the present invention utilizes methyl esters of fatty acids or triglycerides ($C_5$-$C_{22}$) derived from vegetable seeds or animal fats. Methyl soyates (methyl ester of soybean oil) as disclosed herein are commercially available. Examples include SoyGold by A.G. Environmental Products, preferably SoyGold 6000 and SoyGold 1000. Other examples of methyl esters of fatty acids or triglycerides include Oleocal ME-70, Oleocal ME-112, Oleocal ME-30, Erucical ME-106, products of Lambent Technologies; and FAME, fatty acid methyl ester, product of Cargill. The methyl esters of fatty acids or triglycerides can be derived synthetically or from natural products, such as lard, tallow, soybean oil, coconut oil, rapeseed (canola) oil, peanut oil, sunflower oil, or crambe oil. These natural oils typically contain $C_{16}$ palmitic acid, and $C_{18}$ stearic, oleic, linoleic, and linolenic. The composition may be composed of from about 20% to 95% methyl soyate. Preferably the methyl soylate is in the amount of up to or about 30, 40, 50, 55, 60, 65, 75, 80, 85 or 90% of the composition. More preferably the methyl soyate is in the amount up to or about 90% of the composition. The methyl ester of a fatty acid may be a methyl ester of oleic, linoleic, linolenic, palmitic, or stearic acid, naturally derived or synthetically produced, or combination. It is apparent that producing the methyl esters of a fatty acid directly from heterogeneous natural oils is simpler and more economical than making pure methyl esters of individual fatty acids and the results are adequate. The term "methyl esters of a fatty acid" is therefore intended to encompass both heterogeneous preparations from natural oils and pure compositions.

In addition to the methyl esters of fatty acids or triglycerides, to produce a heavy-duty, chlorinated paraffin replacement metalworking fluid, one or more extreme pressure additives are required. In particular, the present invention is directed toward the combination of a methyl ester of fatty acids or triglycerides and a polar non-chlorine extreme pressure (EP) additive, preferably one that is environmentally responsible, e.g. a sulfur- or phosphorus-based amine phosphate, such as phosphate esters, organophosphites, sulfurized hydrocarbon, sulfurized triglycerides, alkylpolysulfides, and alkylamine or alkanolamine salts of phosphoric acid. The combination of these two components provides superior extreme pressure performance, which is seldom observed among conventional base fluid EP blends. The novel formulations provide surprising and unexpected performance characteristics superior to existing biodegradable formulations, in that they can impart a four-ball EP weld point (ASTM D 2783) of at least 400, preferably 620 kg, many as high as 800 kg, and even 800+kg, as demonstrated for inventive products below in Table 1.

High performance metalworking lubricants have many uses in industry. In order to satisfy the specific needs of the ultimate user, it is often necessary for the lubricant to have various performance characteristics. A lubricant's performance characteristics are often measured in terms of four-ball EP LWI (Extreme Pressure Load Wear Index), four-ball Weld Point, four-ball ISL (Initial Seizure Load) and Falex Fail Load. Although each of these characteristics has associated desirable levels, the specific needs of a specific lubricant user may require that no more than one parameter falls within the desirable range.

As used herein, the phrase "four-ball LWI", also known as a measure of load carrying capacity, refers to an index of the ability of a lubricant to prevent wear at applied loads. Under the conditions of this test, specific loadings in kilogram-force, having intervals of approximately 0.1 logarithmic units, are applied by a rotating ball to another three stationary balls for ten runs prior to welding (ASTM D2783). The inventive compositions provide an LWI value of at least about 40. A high performance metalworking lubricant according to the invention is one that has a LWI value of 130 or higher.

As used herein, the phrase "four-ball weld point" refers to the lowest applied load, in kilogram-force, at which the rotating ball seizes and then welds to the three stationary balls. This indicates that the extreme pressure level of the lubricant has been exceeded (ASTM D2783). The test indicates levels stepwise, at 400, 500, 620, 800, and the top value of 800+. A high performance metalworking lubricant as defined here is one that has a weld point of at least 620 kg, preferably 800 kg or exceeding 800 kg (800+).

As used herein, the phrase "four-ball ISL" (initial seizure load) refers to the lowest applied load, in kilogram-force, at which that metal to metal contact between the rotating ball with the three stationary balls occurs. A high performance metalworking lubricant as defined here should have an ISL value of 120 kg or higher. This value is also a measure of the lubricant's film strength.

The Falex Pin and Vee Block test method consists of running a rotating steel journal at 290 plus or minus 10 rpm against two stationary V-blocks immersed in the lubricant sample. Load (pound-force) is applied to the V-blocks by a ratchet mechanism. Increasing load is applied continuously until failure. The fail load value obtained serves to differentiate fluids having low, medium and high level extreme pressure properties. A high performance metalworking lubricant as defined here is one that has a minimum fail load value of 4,000 lbs., preferably 4500 lbs. or exceeding 4500 lbs. This method (ASTM D 3233) is particularly useful for diluted soluble oil samples.

A modified Falex method was developed to detect varnish, gum and sludge formation of a lubricant under stress conditions and to determine dispersing power of the test fluid. This method is similar to the procedure A of the standard Falex EP test (ASTM D 3233) as described above. This modified method requires that the test fluid must have a fail load of 4500 lbs. or higher. Increasing load is applied until reaching 4500 lbs. Load is maintained at 4500 lbs. for 6 minutes. Torque and bulk temperature of the test fluid is measured every 60 seconds. At the end of the test, the test specimens are removed and any varnish, coating or sludge formations around the contact areas are observed. Observations of the used fluids include: clear with deposition of wear debris; homogeneous black dispersion; or black dispersion with deposition of wear debris. A high performance metalworking fluid as defined here should exhibit no or very slight varnish, coating and sludge and it should generate a homogeneous dispersion without noticeable deposition of wear debris in the used fluid.

A real-world field trial is a procedure employed by users who replace the existing commercial metalworking fluid with an experimental one in actual production. Conditions and parameters of each trial are highly individualized to the user's specific equipment and performance situation.

Fine-blanking is a metalworking operation involving a precision, low tolerance, severe cutting/extruding process and a heavy gauge steel stack up to 16 mm in thickness. The contact pressure and temperature between the die and the work piece can reach as high as 200,000 psi and 1,000° C., respectively. This is one of the most difficult metalworking operations known in the industry. Lubricant formulations sufficient for meeting the requirements of this application will also meet the requirements of many other, less demanding applications.

Polarity of an organic compound denotes a shift of electron density within the molecule influenced by the electronegativity of certain elements or groups attached to the compound. As used herein, the phrase "polar non-chlorine extreme pressure additive" refers to any non-chlorine extreme pressure additive that is more polar than organophosphites.

As used herein, the phrase "effectively lubricating" refers to how a lubricant, acting between a tool die and a work piece, satisfactorily meets predetermined metalworking performance requirements without causing excessive friction and wear on the die, as judged comparatively by the equipment operator and his quality control criteria.

For high performance metalworking lubricants, as used herein, the phrase "working strength" refers to the concentration at which the lubricant is used—as is for a straight oil lubricant, or with dilution for a soluble oil. The performance is measured at working strength and while a soluble oil is not typically measured by a four-ball test, a soluble oil at working strength after a standard dilution with water (e.g. 1 to 20) should impart a Falex fail load of at least 4000 lbs, preferably 4500 lbs.

A lubricant composition with good stability as used herein refers to a homogenous or clear composition that will not show any sign of separation, change in color or clarity for a sustained period typically at least one and preferably at least three or at least six months. It should be noted that "good stability," while desirable for many applications, is not required for some applications, e.g. "once through" applications, and should not be considered as a limiting factor to this invention. In some circumstances, a relatively unstable formulation could be prepared just prior to use, substantially reducing any stability-over-time issue.

In an exemplary embodiment of the invention, the polar non-chlorine extreme pressure additive is a sulfur- or phosphorus-based derivative or a combination that is polar and sterically small enough to interact with the metal surface of a work piece together with the methyl ester, and preferably one that is environmentally responsible.

The term phosphorous-based polar non-chlorine extreme pressure additive means a phosphorus-based derivative such as phosphorus-based amine phosphates, including alkylamine or alkanolamine salts of phosphoric acid, butylamine phosphates, long chain alkyl amine phosphates, organophosphites, propanolamine phosphates, or other hydrocarbon amine phosphates, including triethanol, monoethanol, dibutyl, dimethyl, and monoisopropanol amine phosphates. The phosphorus-based derivative may be an ester including thioesters or amides of phosphorous containing acids. The organic moiety from which the phosphorous compound is derived may be an alkyl, alcohol, phenol, thiol, thiophenol or amine. The three organic residues of the phosphate compound may be one or more of these or combinations. Alkyl groups with 1 to 4 carbon compounds are suitable. A total carbon content of 2 to 12 carbon atoms is suitable. The phosphorous based compound may be a phosphorous oxide, phosphide, phosphite, phosphate, pyrophosphate and thiophosphate.

The polar non-chlorine extreme pressure additive may be a sulfur-based derivative such as sulfurized fatty esters, sulfurized hydrocarbons, sulfurized triglycerides, alkyl polysulfides and combinations.

The polar non-chlorine extreme pressure additive may be selected from the group consisting of Desilube 77, RheinChemie RC 8000 and RheinChemie RC2540, RheinChemie 2515, RheinChemie 2526, Lubrizol 5340L, Nonyl Polysulfide, Vanlube 672, Rhodia Lubrhophos LL-550, or EICO 670 or combinations.

Of the several sulfur- or phosphorus-based extreme pressure additives that were tested, the relative effectiveness of these additives in methyl soyate for many applications can generally be rated as follows: Alkylamine or alkanolamine salts of phosphoric acid>sulfurized triglycerides>>sulfurized hydrocarbons=alkylpolysulfides>organophosphites>phosphate esters. Preferably, the polar non-chlorine extreme pressure additive is an amine phosphate blend, such as the commercially available product, Desilube 77, a mixture of organic amine salts of phosphoric and fatty acids (See Product Bulletin re: Desilube™ 77 Lubricant Additive by Desilube Technology, Inc. The composition may be composed of from about 2% to 30% polar non-chlorine extreme pressure additive. Preferably the polar non-chlorine extreme pressure additive is in the amount of up to or about 0.5, 1, 2, 3, 5, 10, 15, or 20% of the composition. The ratio of the methyl ester of fatty acids or triglycerides to the polar non-chlorine extreme pressure additive is in the range of about 1:1.5 to about 48:1.

Most of the methyl esters of fatty acids or triglycerides derived from seed oils or animal fats exhibit a low viscosity (5 to 10 cSt at 40° C.). Depending on a particular metalworking operation, the required viscosity may vary considerably from one application to another. This invention may cover a broad range of metalworking applications from tapping/penetrating fluid (5-20 cSt at 40° C.) to deep drawing (100 to 2,000 cSt at 40° C.) or broader in some embodiments. The invention may require a thickened version of the composition for certain metalworking operations, which require fluids with a high viscosity. So in one aspect of the invention, the composition may further comprise a high viscosity fluid thickener, such as blown seed oils, blown fats, telemers derived from triglycerides, high molecular weight complex esters, polyalkylmethacrylates, polymethacrylate copolymers, styrene-butadiene rubber, malan-styrene copolymers, polyisobutylene, and ethylene-propylene copolymers. Preferably, blown castor oil (e.g. Peacock Blown Castor Oil Z-8) and a complex ester (e.g. Lexolube CG-5000) are used. Combining the methyl soyate and polar non-chlorine extreme pressure additive with a thickener provides the composition with good residency time, film strength, load carrying capacity, and good compatibility with all the components. Residency time refers to the duration of a fluid applied on a work piece that can stay in place prior to metalworking operation. A fluid with an acceptable residency time for fineblanking is one that has a minimum viscosity of 100 cSt at 40° C. A metalworking fluid with good compatibility of all the components is one that shows no sign of separation or change from clear solution to hazy appearance. The composition may be composed of about up to 50% thickener. Preferably the thickener is in the amount of up to or about 10, 15, 20, 25, 30 or 35% of the composition.

In yet another aspect of the invention, depending on the type of extreme pressure additives used, the composition of a methyl ester of fatty acids or triglycerides and polar non-chlorine extreme pressure additive may further comprise a coupling agent and/or surfactant to improve the stability and compatibility of all the ingredients. Such coupling agents as polyethylene glycol esters, glyceryl oleates, sorbitan oleates, and fatty alkanol amides are generally found to be effective. The composition may be composed of up to about 10% coupling agent and/or surfactant. Preferably the coupling agent and/or surfactant is in the amount of up to or about 1, 2, 3, 5, 7 or 7.5% of the composition.

The working strength straight oil composition may comprise a surfactant (detergent). Detergents (surfactants) for the invention may further include the metal salts of sulfonic acids, alkylphenols, sulfurized alkylphenols, alkyl salicylates, naphthenates and other oil soluble mono and dicarboxylic acids such as tetrapropyl succinic anhydride. Neutral or highly basic metal salts such as highly basic alkaline earth metal sulfonates (especially calcium and magnesium salts) are frequently used as such detergents. Also useful is nonylphenol sulfide. Similar materials made by reacting an alkylphenol with commercial sulfur dichlorides. Suitable alkylphenol sulfides can also be prepared by reacting alkylphenols with elemental sulfur. Also suitable as detergents are neutral and basic salts of phenols, generally known as phenates, wherein the phenol is generally an alkyl substituted phenolic group, where the substituent is an aliphatic hydrocarbon group having about 4 to 400 carbon atoms.

In another aspect of the invention, the composition may further comprise an antioxidant and/or a dispersant to reduce or effectively avoid varnish, gum and sludge formation. Methyl soyate, like most of the esters of the vegetable seed oils and animal fats, is inferior to mineral oil in oxidative and thermal stability and can be readily decomposed when subjected to highly stressed conditions, leading to heavy varnish, gum and sludge formation. A number of antioxidants and dispersants, such as those which have been used in automobile engine oils, are quite suitable for these purposes. Both hindered phenols and aromatic amines are effective. Succinimides are found to be good dispersants for methyl soyate-based lubricants. The composition may be composed of up to about 25% antioxidant and/or dispersant. Preferably the antioxidant and/or dispersant is in the amount of up to or about 1, 3, 5, 7, 10, or 15% of the composition.

In another embodiment of the invention, a soluble oil formulation is provided, as concentrate or diluted fluid. This soluble oil combines the benefits of lubricity of the straight oil with the economics and cooling benefit of water. The soluble oil, containing methyl ester of fatty acids or triglycerides, polar non-chlorine extreme pressure additive, and water (or soluble agent) can further comprise mineral oil. Here, the basic combination of methyl ester of fatty acids or triglycerides and polar non-chlorine extreme pressure additive composition further comprises a variety of soluble oil conditioners such as alkanolamines, anionic and nonionic emulsifiers, antioxidants, biocides, corrosion inhibitors, coupling agents, defoamers, mineral oil or water. The methyl ester of fatty acids or triglycerides is generally in amount of about 5% to about 90% of the composition as a concentrate. The polar non-chlorine extreme pressure additive is generally in an amount of from about 3% to about 50% of the composition. The emulsifiers are generally in an amount of about 10% to 50% of the composition. The antioxidants is in an amount of up to about 10% of the composition. The corrosion inhibitors are in an amount of from about 5% to about 40% of the composition. In a preferred embodiment, the corrosion inhibitors contain a boric acid derivative. The coupling agent is in an amount of up to about 10% of the composition. The defoamers are in an amount of up to about 5% of the composition. The water is in the amount of up to about 10% of the concentrated composition. The mineral oil is in an amount of up to about 90% of the composition.

In yet a further aspect of the invention, an anti-bacterial and/or antifungal compound is used to prevent the formation of fungus or bacteria. In addition, water-based metalworking fluids need to be alkaline in pH to minimize problems such as metal corrosion and the growth of microbials. The desired pH is from about 8.5 to about 10. The soluble oil can be diluted with water to a use dilution between about 2% and about 50% (in a dilution range of about 50:1 to 1:1). When diluted to a use level of 5% (20:1), the pH of the two fluids is in the desired range.

EXAMPLES

For screening lubricating performance, both four-ball EP and Falex pin and V-block testers were employed. Two commercial chlorinated paraffins/mineral oil-based fluids containing 35 and 55% chlorine were obtained and evaluated for references. For real-world field trials, the inventors experimented closely with fine-blanking applications, which produces various steel parts used to supply automobile manufacturers. Three chlorinated paraffin-based metalworking fluids containing 15%, 35%, and 55% chlorine, were replaced with one or more non-chlorine fluids for the field trials. For the soluble oil fluids, chlorinated paraffin based, heavy duty fluids prepared just with mineral oil, with mineral oil and triglyceride and with mineral oil and a methyl ester of a triglyceride were used as references.

Screening of Various Extreme Pressure Additives

A number of extreme pressure additives were mixed in methyl soyate (methyl ester of soybean oil). In some cases, coupling agents or surfactants were employed to improve compatibility between the base fluid and the polar non-chlorine extreme pressure additive.

An objective was to replace heavy-duty commercial metalworking fluids containing up to about 55% chlorine, so the concentrations of the extreme pressure additives screened in methyl soyate are relatively high. Lower concentrations of polar non-chlorine extreme pressure additives would be sufficient for applications where lower concentrations of chlorine-containing extreme pressure additives are now used. An established criterion is that the concentration of a polar non-chlorine extreme pressure additive should be sufficiently high to provide a minimum value of four-ball weld point of 620 kg on AISI 52100 steel balls. Another criterion is a Four Ball EP LWI of at least 130. Examples and experimental data are recorded in Table 1 (Examples 1-9). Example formulations 1-6 and 9 qualify as high performance metalworking fluids.

The results in Table 1 show the relative performance of various extreme pressure additives. Most of these formulations (Examples 1-6) exhibit a weld point exceeding 800 kg, which is the maximum load that can be applied on a four-ball testing machine. As seen in Table 1, using the four-ball LWI relative performance value, the compositions can be ranked as follows: alkanol and alkylamine salts of phosphoric acid>sulfurized fatty esters>sulfurized hydrocarbons>alkylpolysulfides>organophosphites>phosphate esters. The most preferred formulation is Example 1.

TABLE 1

Screening of Various Extreme Pressure Additives in Methyl Soyate

| | 1[a] | 2[b] | 3 | 4 | 5 | 6 | 7[a] | 8 | 9 |
|---|---|---|---|---|---|---|---|---|---|
| Methyl Soyate (SoyGold 1000) | 77.5 | 75.0 | 85.0 | 85.0 | 85.0 | 85.0 | 77.5 | 85.0 | 85.0 |
| Amine Phosphates (Desilube 77) | 15.0 | | | | | | | | |
| Propanolamine Phosphate | | 10.0 | | | | | | | |
| Butylamine Phosphate | | | 15.0 | | | | | | |
| Sulfurized Fatty Ester (Additin RC 2515) | | | | 10.0 | | | | | |
| Sulfurized Fatty Ester (Additin RC 2526) | | | | 5.0 | | | | | |
| Sulfurized Hydrocarbon (Lubrizol ™ 5340L) | | | | | 15.0 | | | | |
| Alkyl polysulfide (Nonyl Polysulfide) | | | | | | 15.0 | | | |
| Long Chain Alkyl Amine Phosphate (Vanlube ® 672) | | | | | | | 15.0 | | |
| Phosphate Ester (Lubrhophos/LL-550) | | | | | | | | 15.0 | |
| Organo Phosphite (ELCO 670) | | | | | | | | | 15.0 |
| Four-Ball EP Weld Point | 800+ | 800+ | 800+ | 800+ | 800+ | 800+ | 500 | <500 | 620 |
| Four-Ball EP LWI | 239 | 214 | 190 | 164 | 154 | 150 | 89 | | 130 |

[a]Containing 7.5% glyceryl monooleate as coupling agent

[b]Containing 5% glyceryl monooleate and 10% ethoxylated + tolloamine

The components listed in Table 1 are commercially available. Additin RC 2515 by Rhein Chemie Corp., is a sulfurized vegetable fatty ester and hydrocarbon. Additin RC 2526 by Rhein Chemie Corp., is a sulfurized vegetable fatty acid ester, fatty acid and hydrocarbon. Lubrizol™ 5340L by the Lubrizol Corporation, is an olefin sulfide. Vanlube® 672 by R.T. Vanderbilt is a long chain alkylamine phosphate. ANTARA LL-550 (Lubrhophos) by Rhone-Poulenc is a free acid form of a complex organic phosphate ester. ELCO-670 by the ELCO Corporation is an alkyl phosphite alkanolamine ester polymer.

Comparative Ep Performance of Methyl Soyate, Soybean Oil, and Mineral Oil

Among various base fluid/polar non-chlorine extreme pressure additive combinations, the performance of methyl soyate/extreme pressure additive systems stand out in comparison with those of mineral and soybean oil formulations (see results in Table 2 below). The lubricating properties of the methyl soyate and polar non-chlorine extreme pressure additive combination are compared with other fluids, wherein five extreme pressure additives are compared in three base fluids—methyl soyate, soybean oil, and mineral oil. At 15% total EP concentration, the methyl soyate-based fluid consistently outperforms the soybean- and mineral oil-based fluids. One exception is the polar non-chlorine extreme pressure additive—organophosphite. This exception is attributed to the low polarity of the organophosphites. However, even in this combination the methyl soyate combination outperforms the paraffin oil formulation. The experimental results are recorded in Table 2 (Examples 10-20). Based on the four-ball weld point and LWI results, the combinations of methyl soyate and polar non-chlorine extreme pressure additives (Examples 10, 13, and 19) consistently outperform the mineral oil and soybean oil counterparts (Examples 11, 12, 14, 15 and 20). The preferred formulations are Examples 10, 13 and 19. The most preferred formulation is Example 10.

Lubrizol 5340L, by Lubrizol Corporation is a sulfurized hydrocarbon. Paraffinic mineral oil (200 SUS) by Sun Oil Company is a mineral oil consisting mostly of alkyl hydrocarbons. It is generically referred to as "mineral oil." Soybean Oil (IV 120) is a commercial product with iodine number of 120, supplied by Cargill. Its general name is "soybean oil."

Effect of Ep Performance of Amine Phosphates in Methyl Soyate/Mineral Oil Blends The EP performance of a combination of methyl soyate and polar non-chlorine extreme pressure additives is demonstrated in a series of six mineral oil/methyl soyate blends as shown in Table 3 below. Having a constant and fairly low concentration of a polar non-chlorine extreme pressure additive (5% of an amine phosphate blend), the four-ball EP weld point gradually increased with increasing methyl soyate concentration. A dramatic increase in four-ball weld point was observed when the weight ratio of mineral oil to methyl soyate approached 10/90. This dramatic increase in four-ball weld point is unexpected based on ordinary experience of a lubrication practitioner working with various base fluid/polar non-chlorine extreme pressure additive combinations. This suggests a synergism between the methyl soyate base fluid and the polar non-chlorine extreme pressure additive.

A series of six experiments were carried out to determine the EP performance of a blend of polar amine phosphates (Desilube 77—a proprietary blend of amine phosphates) in mixtures of methyl soyate and mineral oil. The concentrations of the polar non-chlorine extreme pressure additive and coupling agent are kept constant. The only variable is the ratio of mineral oil to methyl soyate. The four-ball weld points and load wear indices are determined The experimental data are recorded in Table 3 (Examples 21-26). The mineral oil-free methyl soyate-EP additive formulation (Ex. 26) outperformed the 10/90 formulation (Ex. 25).

TABLE 2

Comparative EP Performance of Selected EP Additives in Methyl Soyate, Mineral Oil, and Soybean Oil

| Composition (%) | 10[a] | 11[a,c] | 12[b] | 13 | 14 | 15[b] | 16 | 17 | 18 | 19 | 20 |
|---|---|---|---|---|---|---|---|---|---|---|---|
| Methyl Soyate (SoyGold 1000) | 77.5 | | | 85.0 | | | 85.0 | | | 85.0 | |
| Paraffinic Mineral Oil (200 SUS) | | 72.5 | | | 85.0 | | | 85.0 | | | 85.0 |
| Soybean Oil (IV:120) | | | 80.0 | | | 80.0 | | | 85.0 | | |
| Amine Phosphate Blend (Desilube 77) | 15.0 | 15.0 | 15.0 | | | | | | | | |
| Organophosphite (ELCO 670) | | | | | | | 15.0 | 15.0 | 15.0 | | |
| Sulfurized Hydrocarbon (Lubrizol 5340L) | | | | 15.0 | 15.0 | 15.0 | | | | | |
| Sulfurized fatty Ester (Additin RC 2515) | | | | | | | | | | 10.0 | 10.0 |
| Sulfurized Fatty Ester (Additin RC 2526) | | | | | | | | | | 5.0 | 5.0 |
| Four-Ball EP Weld Point | 800+ | 800 | 800 | 800+ | 800 | 800 | 620 | 620 | 800 | 800+ | 800 |
| Four-Ball EP LWI | 239 | 184 | 221 | 154 | 117 | 119 | 143 | 130 | 203 | 164 | 153 |

Containing 7.5% glyceryl monooleate
Containing 5% glyceryl monooleate
Containing 5% lard oil

TABLE 3

Effect of Different Methyl Soyate/ Mineral Oil Weight Ratios on Four-Ball EP Performance

| Composition | 21 | 22 | 23 | 24 | 25 | 26 | 26A |
|---|---|---|---|---|---|---|---|
| Paraffinic Mineral Oil (200 SUS), Wt. % | 90.0 | 63.0 | 45.0 | 27.0 | 9.0 | 0 | 0 |
| Methyl Soyate, Wt. % | 0 | 27.0 | 45.0 | 63.0 | 81.0 | 90.0 | 90.0[1] |
| Mineral Oil/Methyl Soyate, Wt % | 100/0 | 70/30 | 50/50 | 30/70 | 10/90 | 0/100 | 0/100 |
| Glyceryl Monooleate, Wt. % | 5.0 | 5.0 | 5.0 | 5.0 | 5.0 | 5.0 | 5.0 |
| Amine Phosphate Blend (Desilube 77), Wt % | 5.0 | 5.0 | 5.0 | 5.0 | 5.0 | 5.0 | 5.0 |
| Four-Ball EP, Weld Point, kg | 400 | 400 | 400 | 500 | 800 | 800 | 800 |
| Four-Ball EP, LWI | 115 | 57 | 64 | 90 | 153 | 167 | 170 |

[1]Priolube 1400, Methyl Oleate, Uniquema

The results listed in Table 3 further clarify several important aspects relating to this invention. First, a synergism between methyl soyate and a polar non-chlorine extreme pressure additive is again confirmed. Comparing the four-ball data between the mineral-based and methyl soyate-based formulations (Examples 21 vs. 26), the lubricating properties of Example 26 are far superior. Secondly, if one decides to use a blend of methyl soyate and mineral oil for economic reasons, selection of a right ratio of methyl soyate to mineral oil is crucial in order to maximize the EP performance (Example 25 vs. 22-24). Thirdly, Example 26A is based on a pure methyl ester of oleic acid and its EP performance is comparable to Example 26. The pure methyl oleate may be preferred over heterogeneous methyl soyate because of its superior thermal and oxidative stability due to fewer number of carbon-carbon double bonds in the methyl oleate. The preferred formulations are Examples 26 and 26A.

Thickened Methyl Soyate Formulations

The viscosity of a metalworking fluid can play an important role in its overall performance. High viscosity of a metalworking fluid can improve residency time, film strength, and load carrying capacity depending on the nature of the thickener. Kinematic viscosity, cSt ($mm^2/s$), is obtained by measuring the time in seconds for a fixed volume of liquid to flow under gravity through the capillary of a calibrated viscometer under a reproducible driving head and at a closely controlled temperature. The kinematic viscosity is the product of the measured flow time and the calibration constant of the viscometer (ASTM D445).

The viscosity of methyl soyate is quite low in comparison with most of the mineral oils used in metalworking fluids. Most of the metalworking fluids based on methyl soyate require thickening. Several thickeners were selected, formulated and evaluated. The experimental results are recorded in Table 4 (Examples 27-34). The lubricating performance results of two commercial metalworking fluids containing 35% and 55% chlorine are also recorded in Table 4 (Comparative Examples 35-36). The use of a thickener is a methyl soyate-based metalworking fluid may be necessary for some applications. The main objectives are to improve residency time, film strength as measured by four-ball ISL (initial seizure load), and load carrying capacity as measured by four-ball LWI. Residency time, film strength and load carrying capacity were as defined above.

The data listed in Table 4 show that a viscosity of a methyl soyate fluid can be readily increased by employing a suitable thickener. The difference in performance between a thickened and un-thickened fluid can be significant as shown in Examples 27 and 28. Example 28 is a thickened version of Example 27. In actual field trials, Example 28 was successful in replacing 35% chlorine fluid whereas Example 27 was not (see Table 5). The preferred formulations are Examples 27, 28, 29, 30, 31, 32, 33 and 34. The most preferred formulation is Example 28.

Examples 35 and 36 are commercial metalworking fluids containing 35% chlorine and 55% chlorine, respectively. The four-ball EP performance properties were obtained on these two fluids for references.

TABLE 4

Thickened Methyl Soyate-Based Fluids and Commercial Chlorine-Containing Metalworking Compounds

| | 27 | 28 | 29 | 30 | 31 | 32[a] | 33 | 34 | 35[b] | 36[c] |
|---|---|---|---|---|---|---|---|---|---|---|
| Field Trial/Sample/ Commercial Product | DL1 5 | DL1 5A | DL1 5B | DL1 5C | | | | | 35% CL | 55% CL |
| Methyl Soyate (SoyGold 1000) | 77.5 | 62.0 | 49.0 | 55.0 | 60.0 | 39.0 | 66.3 | 65.0 | | |
| Amine Phosphate Blend (Desilube 77) | 15.0 | 15.0 | 15.0 | 15.0 | 15.0 | 19.5 | 15.3 | 15.0 | | |
| Glyceryl Monooleate | 7.5 | 7.5 | 7.0 | 5.0 | 5.0 | 4.7 | 3.1 | 5.0 | | |
| Polymeric Ester (Inolex CG 5000) | | 15.5 | 29.0 | | | | | | | |
| Blown Castor Oil (Z8) | | | | 25.0 | | 34.4 | | | | |
| Polyalkylmethacrylate (Viscoplex 8-702) | | | | | 20.0 | | | | | |
| Polymethacrylate Copolymer (LZ7785) | | | | | | | 15.3 | | | |
| Malan Styrene Copolymer (LZ3702) | | | | | | | | 15.0 | | |
| Viscosity at 40° C., cSt (SUS) | 10 (60) | 34.3 (162) | 118 (542) | 88 (404) | 85 (395) | 109 (500) | 34 (162) | 32 (150) | 104 (342) | 359 (1656) |
| Four-Ball EP Weld Point (kg) | 800+ | 800+ | 800+ | 800+ | 800+ | 800+ | 800+ | 800+ | 315 | 800+ |
| Four-Ball EP LWI | 239 | 161 | 195 | 203 | 174 | 180 | 150 | 160 | 56 | 191 |
| ISL | 126-160 | 160-200 | 250 | 250-315 | 160-200 | 250 | 160-200 | 160-200 | | 160 |

[a]Containing 2.4% polyoxylated tolloamine (Rhodamin PN 430)
[b]Commercial chlorinated paraffin/mineral oil metalworking fluid containing 35% chlorine
[c]Commercial chlorinated paraffin/mineral oil metalworking fluid containing 55% chlorine Lexolube CG-5000 by Inolex Chemical Company is a polyester. Peacock Blown Castor Oil Z-8 by Geo. Pfau's Sons Company, Inc., is an oxidized, polymerized fatty oil. Viscoplex® 8-702 by RohMax USA, Inc., is a solution of polyalkyl methacrylate (PAMA) in a highly refined mineral oil. Lubrizol 7785, supplied by Lubrizol Corporation, is a polymethacrylate copolymer. Lubrizol 3702, supplied by Lubrizol Corporation, is an ester-styrene copolymer (also known as Malan-styrene copolymer).

Selected Formulations for Field Trials

Experimental and field trial results are listed in Table 5.

Desilube BioDraw 15B (Example 29) and Desilube BioDraw 15C (Example 30) are also thickened versions of BioDraw 15 (Example 27) and show higher viscosities than BioDraw 15A. In fine-blanking, these two fluids exhibit good residency times and are successful in replacing a 35% chlorine-containing fluid. These fluids also provide good lubricating properties on fine-blanking 16 mm steel, for which 55% chlorine is required. For prolonged use at the 55% chlorine replacement level, heavy build-ups on tool dies were initially observed resulting in rapid increases of surface roughness on the work pieces.

TABLE 5

Field Trial Results Obtained on Fine-blanking

| Curve No. | Product Description | Weld Point, Kg | LWI | Scar Diameter Before Weld mm (kg) | Viscosity at 40° C. cSt (SUS) | Field Trial Result |
|---|---|---|---|---|---|---|
| 1 | FB 349 35% Chlorine Commercial Product [Example 35] | 315 | 56 | 1.93 (250) | 104 (482) | Current WFB Product; fine-blanking 8 mm 1018 steel; surface finish 86-124 |
| 2 | FB 384 55% Chlorine Commercial Product [Example 36] | 800+ | 191 | 1.78 (800) | 358 (1656) | Current WFB product; fine-blanking 16 mm steels & alloys |
| 3 | Example 27 from Table 4 Desilube BIODRAW 15 | 800+ | 239 | 1.2 (800) | 10 (60) | First sample tested for fine-blanking 8 mm steel; Surface finishes: 48-133 (500 pieces) Frequent tearing. Overall result: unacceptable |
| 4 | Example 28 from Table 4 Desilube BIODRAW 15A | 800+ | 248 | 1.53 (800) | 34 (162) | Second sample tested for fine-blanking 8 mm steel; Surface finishes: 90-129 (500 pieces). Overall result: good |
| 5 | Desilube MW 100 Mineral oil 78% DL77 - 15% Arlacel 83 - 7% | 800 | 239 | 1.28 (620) | 130 (650) | Third sample tested for fine-blanking 1018 steel; Surface finishes: 134-181 (100 pieces). Overall result: unacceptable |
| 6 | Example 29 from Table 4 Desilube BIODRAW 15B | 800+ | 237 | 1.53 (800) | 118 (542) | Good on 8 mm steel stock. Too much build-up on fine-blanking 16 mm steel. |
| 7 | Example 30 from Table 4 Desilube BIODRAW 15C | 800+ | 272 | 1.58 (800) | 88 (404) | Good on 8 mm steel stock. Heavy buildup on tool die. |

FB 349 is a chlorinated-paraffin metalworking fluid (35% chlorine), supplied by Benz Oil. Arlocal 83, and sorbitan sesquinoleate were supplied by Uniquoma.

Five formulations were tested for fine-blanking purposes—four soy-based and one mineral oil-based fluid. Desilube BioDraw 15, the first fluid tested, marginally passed a field trial. Desilube BioDraw 15A, a thickened version of BioDraw 15, performed very well in a field trial. BioDraw 15A exhibits comparable performance to a 35% chlorine-containing commercial product A mineral oil-based fluid (Desilube MW 100) contains an identical EP component to that of Ex. 28, Desilube 15A. Even with a higher viscosity than 15A, Desilube MW 100 does not pass the field trial to replace a 35% chlorine fluid, showing the superiority of methyl soyate over mineral oil.

After screening various sulfur- or phosphorus-containing extreme pressure additives in methyl soyate, and based on combining the values of four-ball weld point and load wear indices as references, a clear trend emerges: Polarity of an extreme pressure additive plays an important role in the EP performance. Higher polarity of an EP additive in methyl soyate produces higher EP performance. Correspondingly, the relative effectiveness of different additives may be rated as follows: Alkylamine or alkanol amine salts of phosphoric acid>sulfurized triglycerides>>sulfurized hydrocarbons=alkylpolysulfides>organophosphites>phosphate esters.

This unique behavior of methyl soyate/polar non-chlorine extreme pressure additive combinations is further demonstrated by investigating and comparing two additional fluids a paraffinic mineral oil (200 SUS) and a soybean oil (IV no 120). Using the same EP formulations and concentrations in all three fluids, the methyl soyate-based fluids consistently outperform both the mineral oil and soybean oil-based formulations. The only exception is an organophosphite that is much less polar than the other extreme pressure additives. These results suggest a synergism between methyl soyate and polar non-chlorine extreme pressure additives.

The extreme pressure performances of a series of six formulated fluids (Examples 21-26) were determined to elucidate the possible mechanism of the synergism between methyl soyate and a polar non-chlorine extreme pressure additive.

The six fluids contain both a mineral oil and methyl soyate. Four of the six blends studied have various weight ratios and are formulated with the same concentration of an EP package consisting of 5% polar non-chlorine extreme pressure additive (Desilube 77) and 7.5% glyceryl monooleate. Beside the pure fluids, the only variable in these blends is the weight ratio of methyl soyate to mineral oil.

Figure 3:
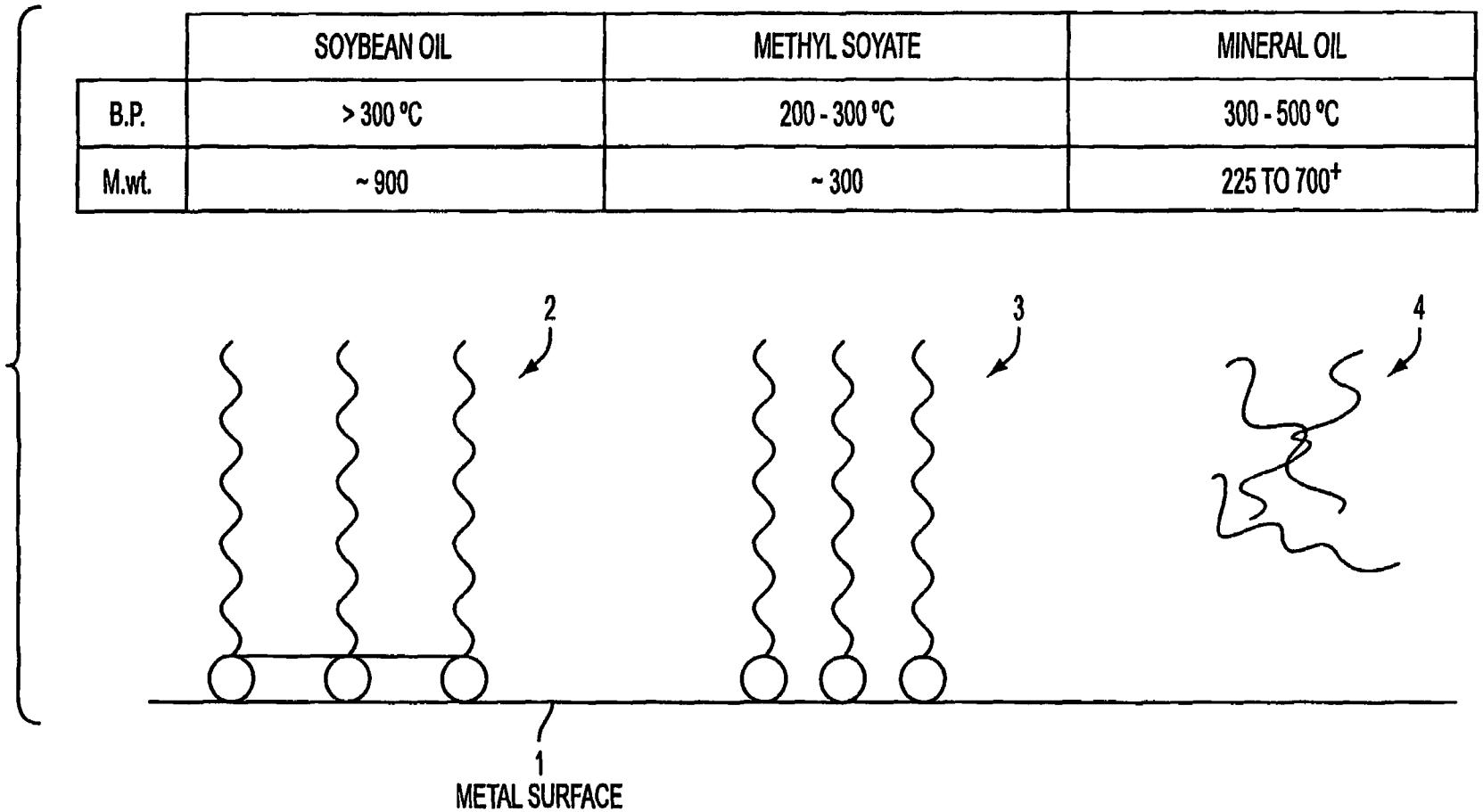
FIG. 3 illustrates comparative properties of soybean oil (bp>300° C., MW ~900), methyl soyate (bp 200-300° C., MW ±300), and mineral oil (bp 300-500° C., MW 225-700$^{+}$).

The results suggest that a combination of methyl soyate and a polar non-chlorine extreme pressure additive may operate under two different mechanisms. These are only potential mechanisms and are not intended to limit the scope of the invention. FIG. 3 illustrates comparative properties of soybean oil (bp>300° C., MW ±900), methyl soyate (bp 200-300° C., MW ±300), and mineral oil (bp 300-500° C., MW 225-700$^{+}$). As shown in FIG. 3, the polar groups of the soybean oil triglycerides 2 interact with the metal surface 1 to provide some lubrication. The polar heads of the methyl ester 3 likewise interact with the metal surface so the non-polar hydrocarbon chains line up way from the surface. Mineral oil 4 does not interact or line up in such a fashion.

Figure 4:
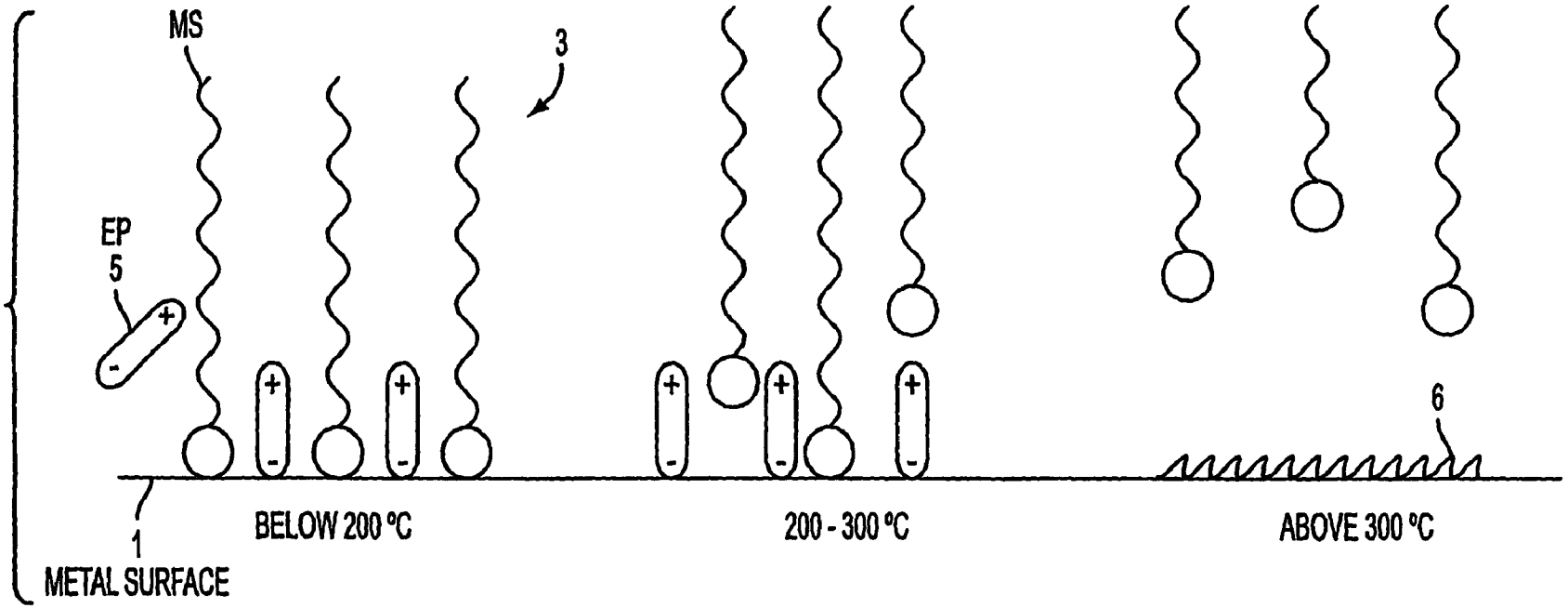
FIG. 4 depicts aspects of a hypothetical mechanism for the performance of the inventive metalworking fluids.

FIG. 4 depicts aspects of a hypothetical mechanism for the performance of the inventive metalworking fluids. As shown in FIG. 4, below 200° C. the methyl ester molecules 3 line up with polar groups interacting with the metal surface 1 as shown in FIG. 3, with the polar EP additive 5 interspersed between the methyl esters, near or away from the metal surface 1. At 200-300° C. the methyl soyate molecules begin to boil away, the EP molecules therefore becoming concentrated at the metal surface. Above 300° C., the methyl esters are removed, and the EP additive is activated and reacts with the metal surface, forming protective compounds at the surface 6 such as (for phosphorous-based EP additives) phosphides, phosphates, etc.

Both methyl soyate and the polar non-chlorine extreme pressure additive are quite polar and they tend to compete for the same metal surface. As the concentration of methyl soyate increases, one would expect that the EP performance should decrease because of a higher concentration of methyl soyate adsorbed on the metal surface compared with the polar non-chlorine extreme pressure additive. A gradual increase in anti-wear properties is observed with increasing methyl soyate concentration until a critical concentration of methyl soyate is reached. At this point, a dramatic increase in four-ball weld point (EP properties) is observed. This can be explained in terms of the three lubrication regimes—hydrodynamic, hydrodynamic/boundary mixing region, and boundary region. In the hydrodynamic and hydrodynamic/boundary mixing region, an increase of methyl soyate concentration would improve the anti-wear properties and decrease the coefficient of friction due to higher equilibrium concentration of methyl soyate adsorbed on the metal surface. The combined effect of low coefficient of friction, improved anti-wear properties, and the high viscosity index of methyl soyate is able to extend the superior lubricating characteristics deep into the hydrodynamic/boundary mixing region in which most of the conventional EP/anti-wear additives and frictional modifiers in mineral oil systems can not penetrate. This is reflected by the gradual increase of load wear index with increase of methyl soyate concentration. However, no significant increase of weld point is detected until a critical concentration of methyl soyate is obtained.

In the boundary regime, the methyl soyate concentration is at or exceeds the critical level. Here a different lubrication mechanism probably manifests. An increase in load causes an increase in localized surface temperature (metal-metal contact area) resulting from metal deformation and friction. As the surface temperature approaches 200° C. or higher (methyl soyate starts to boil around 200° C.), de-adsorption of methyl soyate from the metal surface combines with "localized boiling." This produces a cooling effect and removes heat from the metal surface. In the meantime, the concentration ratio of the adsorbed methyl soyate to the polar non-chlorine extreme pressure additive shifts in favor of increasing adsorption of the less volatile extreme pressure molecules. Simultaneously, activation of the polar extreme pressure molecules occurs, resulting in a dramatic increase of extreme pressure performance as indicated by a sudden rise of the four-ball weld point with increasing temperature and thus preventing metal fusion. A similar mechanism is thought to occur in the soluble of composition where the water and methyl ester boil off together.

The Use of Anti-Oxidant and Dispersant in High Performance Metalworking Fluids

The invention permits replacement of chlorinated paraffin fluids containing high chlorine content up to a maximum of 55%. This type of high chlorine-containing fluid has been employed under a set of very severe conditions of high temperature, high load, high torque, high friction, and high speed. Methyl soyate, like most of the esters of the vegetable seed oils and animal fats, is inferior in oxidative and thermal stability to mineral oil and can be readily decomposed when subjected to highly stressed conditions. In two early field trials using methyl soyate-based fluids to replace a 55% chlorine-containing fluid, difficulties were experienced due to heavy varnish, gum and sludge formation on the tool dies.

The use of antioxidant and/or dispersant in the methyl soyate/polar non-chlorine extreme pressure additive formulations is preferred for many high performance applications. Examination of a number of formulations by a modified Falex bench procedure showed that use of a suitable combination of antioxidants and/or dispersants in a methyl soyate-based metalworking fluid can significantly reduce varnish, gum and sludge formation under fine-blanking conditions.

Table 6 (Examples 37-43) lists a number of selected formulations showing the difference in varnish/gum/sludge formation in a fine-blanking application with the use of antioxidant/dispersant combinations.

A number of antioxidants and dispersants, which have been used in automobile engine oils, are quite suitable for these purposes. Both hindered phenols and aromatic amines are effective. Succinimides are found to be good dispersants for methyl soyate-based lubricants.

TABLE 6

High Performance Metalworking Fluids Containing Antioxidant and Dispersant

| Ingredient | Function | 37 | 38 | 39 | 40 | 41 | 42 | 43 | 44 |
|---|---|---|---|---|---|---|---|---|---|
| Methyl Soyate (SoyGold 1000) | Base Fluid | 58.0% | 55.0% | 53.0% | 57.05 | 29.0% | 28.5% | 40.5% | Comm. Chlorinated Paraffin Fluid, 55% Cl |
| Bln Castor Oil (Z8) | Thickener | — | — | — | — | 17.0 | — | — | — |
| Complex Ester CG 5000) | Thickener | 15.0 | 15.0 | 14.0 | 10.0 | — | 16.0 | — | — |
| Viscoplex 8-702 | Thickener | — | — | — | — | — | — | 10.0 | — |
| Desilube 77 | Pol. EP | 20.0 | 20.0 | 19.0 | 20.0 | 20.0 | 20.0 | 20.0 | — |
| RC 8000 | Pol. EP | — | — | — | — | 20.0 | 20.0 | 15.0 | — |
| RC 2540 | Pol. EP | — | — | — | — | 3.0 | 3.0 | 5.0 | — |
| LZ 7652 | AntiOxid | — | 3.0 | 3.0 | 3.0 | — | — | — | — |
| Irg L109 | AntiOxid | — | — | — | — | 0.5 | 0.5 | 0.5 | — |
| Irg L57 | AntiOxid | — | — | — | — | 0.5 | 1.0 | 1.0 | — |
| HiTec 646 | Dispersant | — | — | 4.0 | 10.0 | 8.0 | 8.0 | 8.0 | — |
| Glycerol Monooleate | Coupling Agent | 7.0 | 7.0 | 7.0 | — | 2.0 | 2.0 | — | — |
| Propylene Glycol | Coupling Agent | — | — | — | — | — | 1.0 | — | — |
| Four-Ball EP ASTM D-2783 | | $800^+$ | $800^+$ | $800^+$ | $800^+$ | $800^+$ | $800^+$ | $800^+$ | $800^+$ |
| Falex EP ASTM D-3233 | | $4500^+$ | $4500^+$ | $4500^+$ | $4500^+$ | $4500^+$ | $4500^+$ | $4500^+$ | $4500^+$ |
| *Mod. Falex | Varnish | H | M | L | L | L | L | L | O |
| EP 4500 lbs = | Gum | H | M | L | O | L | O | O | O |
| 6 min | Sludge | H | M | L | O | L | O | O | O |

*Modified Falex EP Rating: H = heavy; M = medium; L = light; O = none (deposit formation on test specimens)

Additin RC 8000 by Rhein Chemie Rheinau GmbH, is a sulfur-linked natural ester. Additin RC 2540 by Rhein Chemie, is a dialkyl polysulfide. Lubrizol 7652, by Lubrizol Corporation, is a blend of antioxidants consisting of alkylated phenol, hydroxyalkyl carboxylic ester and diphenylamine. Irganox L109, by Ciba Corporation, is a hindered bis-phenolic anti-oxidant. Irganox L57, by Ciba Corporation, is a liquid octylated/butylated diphenylamine. Hitec 646, by Ethyl Corporation, is a succinimide dispersant.

In yet another embodiment representing the soluble heavy-duty formulation, the methyl soyate and soybean oil were incorporated into the heavy-duty soluble oil formulation at a 5% concentration to determine its influence on the performance of the fluid. Table 7 lists the following three references: a chlorinated paraffin based formulation with mineral oil (Example 45), a chlorinated based formulation with mineral oil and soybean oil (Example 46) and a chlorinated paraffin based formulation with mineral oil and methyl soyate (Example 47).

TABLE 7

Heavy Duty Soluble Oil Formulations

| Component | Example 45 | Example 46 | Example 47 |
|---|---|---|---|
| 100 SUS Naphthenic | 55.1% | 48.9% | 48.9% |
| Petromix #9 | 20.4% | 20.1% | 20.1% |
| Chlorinated Paraffin | 20.4% | 20.0% | 20.0% |
| Triazine | 1.6% | 3.0% | 3.0% |
| Tall Oil Fatty Acid | 2.5% | 3.0% | 3.0% |
| Soybean Oil | — | 5.0% | — |
| Methyl Soyate | — | — | 5.0% |
| pH, 5% Solution | 9.6 | 9.3 | 9.2 |

Falex Pin and Vee Block and Cast Iron Chip Test results for these three fluids are shown in Table 8. The fluids were diluted to 5% in tap water for the Falex procedure and to 4% in 100 ppm for the Cast Iron Chip Test.

TABLE 8

Falex Pin and Vee Block and Cast Iron Chip Test Results

| | Falex Pin and Vee Block Results (failure load in lbs) | Cast Iron Chip Test Results (% of the surface covered with iron) |
|---|---|---|
| Example 45 | 4,200 | 3% |
| Example 46 | 4,250 | 2% |
| Example 47 | 4,100 | 2% |

Usage of chlorinated paraffins in soluble oils leads to a dramatic improvement in failure load in the Falex pin and Vee Block Test Employment of soybean oil and methyl soyate in the heavy-duty formulation does not produce any change in the Falex performance. Both soybean-based products do not have a negative impact on the cast iron chip test results.

Consistent with the goals of the invention, a second approach was taken to develop a more environmentally friendly, metalworking fluid utilizing a chlorine free, extreme pressure additive (i.e. Desilube 77) in place of chlorinated paraffin. Three mineral oil based fluids were developed as part of this phase of the project. A control fluid formulated just with Desilube 77 (Example 48) and blends prepared with soybean oil (Example 49) and methyl soyate (Example 50). The three formulations are shown in Table 9.

TABLE 9

Chlorine Free, Heavy Duty Soluble Oil Formulations

| Component | Example 48 | Example 49 | Example 50 |
|---|---|---|---|
| 100 SUS Naphthenic Oil | 42.7% | 26.8% | 25.0% |
| Petromix #9 | 10.2% | 10.8% | 10.0% |
| Soybean Oil | — | 9.1% | — |
| Methyl Soyate | — | — | 8.0% |
| Desilube 77 | 3.9% | 5.2% | 4.0% |
| Triethanolamine | 5.9% | 5.6% | 5.0% |
| Glycerol Monooleate | 9.4% | 10.4% | 4.0% |
| Triazine | 2.3% | 3.5% | 4.0% |
| 45% Potassium Hydroxide | 2.3% | 3.5% | 4.0% |
| Westvaco M 28B | 5.9% | 10.0% | 9.0% |
| Tween 80 | 7.4% | 6.1% | 2.0% |
| Gateway CP-105 | 10.0% | 10.8% | 10.0% |
| Igepal CO-530 | — | — | 10.0% |
| Propylene Glycol | — | — | 6.0% |
| pH, 5% in Water | 8.9 | 9.0 | 9.2 |

100 SUS Naphthenic Oil, Petromix #9 by Crompton Corporation, is a petroleum sulfonate based emulsifier (an anionic emulsifier). Triazine is hexahydro-1,3,5 tris (2-hydroxyethyl)-8-triazine. Westvaco M 28B is a tall oil fatty acid (anionic soap). Tween 80 (nonionic surfactant) is POE (2) sorbitan monooleate, Gateway CP-105, by Gateway Additives, is a corrosion inhibitor. Igepal CO-530 (nonionic surfactant), by Rhodia Corporation, is a nonyl phenol 6-mole ethoxylate.

Additional components were needed to stabilize these formulations. Petromix #9, potassium salt of Westvaco M-28B, glycerol monooleate, Tween 80 and Igepal CO-530, and a coupling agent (propylene glycol) were utilized in the formulation work. Gateway CP-105 was also utilized to improve the corrosion protection of the fluids.

Data produced from the evaluation of the lubricity and corrosion inhibition characteristics of Example 48 through Example 50 are shown in Table 10. All fluids were diluted to 5% in tap water for the Falex Pin and Vee Block procedure and to 4% in 100 ppm water for the Cast Iron Chip Test.

TABLE 10

Falex Pin and Vee Block and Cast Iron Chip Test Results

| | Falex Pin and Vee Block Results (failure load in lbs) | Cast Iron Chip Test Results (% of the surface covered with rust) |
|---|---|---|
| Example 48 | 4,300 lbs | 4% |
| Example 49 | 4,300 lbs | 2% |
| Example 50 | 4,300 lbs | 0% |

The chlorine free, environmentally friendly fluids generate comparable Falex Pin and Vee Block and Cast Iron Chip Test results as compared to Examples 45-47. These results mean that Examples 49 and 50 are quite suitable for use in performance trials as alternatives to the traditional chlorinated paraffin-based, heavy-duty soluble oils.

Example 50 was further evaluated by first conducting a lab evaluation. The purpose of the lab testing was to determine if the fluid could generate any adverse effects in a field trial. Results from the lab testing are shown in Table 11.

TABLE 11

Example 50-Lab Testing Results

| Test | Result |
|---|---|
| Fluid Appearance | Clear Amber Liquid |
| H, 5% Tap Water | 9.36 |
| Specific Gravity, 60/60° F. | 0.9953 |
| Cast Iron Chip Test, 3% Concentration in Tap Water | No Rust |
| Cast Iron Chip Test, 4% Concentration in Tap Water | No Rust |
| Cast Iron Chip Test, 5% Concentration in Tap Water | No Rust |
| Cast Iron Chip Test, 3% Concentration in 27 Grain (460 ppm) Water | Moderate Rust |
| Cast Iron Chip Test, 4% Concentration in 27 Grain (460 ppm) Water | Moderate Rust |
| Cast Iron Chip Test, 5% Concentration in 27 Grain (460 ppm) Water | Moderate Rust |
| Aluminum Stain | No Stain |
| Copper Stain | Trace Stain |
| Foam Test | 6 mm Foam Height Initially<br>4 mm Foam Height After 5 Minutes |
| Tramp Oil Rejection | 10 mls Clear |
| Residue | Oily |

Based on this testing, Example 50 displays good rust protection on ferrous metals and will not stain aluminum. The slight stain on copper is of no concern. Corrosion protection under hard water conditions tends to deteriorate. Example 50 can be used on most steels and aluminum without concern for corrosion generation. Improved corrosion protection would be needed to operate Example 50 on cast iron.

Example 50 displays average foam control which means that the product could pose a problem in high pressure, high speed machining systems. The product does reject tramp oil, which is important, because entrainment of this material will lead to decreased fluid life. An oily residue gave a sense of how the product will dry on a machine surface. This type of residue is much easier to clean off than a tacky finish on metal surfaces.

Overall, Example 50 is an acceptable fluid, which could be evaluated in field trials. The first field trial conducted on Example 50 took place over a six-week period. The trial parameters are shown in Table 12.

TABLE 12

Example 50-First Trial Parameters

| Parameter | |
|---|---|
| Machine Type | Daewoo Puma 8S CNC Turning Center |
| Machining Operations | Drilling and Tapping Small Components |
| Metals Used | Tool Steel, Plastic (Delron and Acrylic), 1117 Steel, 4140 Steel and 6061 Aluminum |
| Sump Size | 100 Gallons |
| Initial Fluid Concentration | 5% |

At the completion of the trial, the fluid held up well even though the machining operations were not that rigorous. The main problem with the fluid is rancidity. Due to the use of methyl soyate and other components, Example 50 is susceptible to bacterial degradation, which can lead to rancidity. This phenomenon is detected when the fluid generates foul odors. The operator doing the trial needed to add biocide on a weekly basis to counteract the bacterial attack.

Other preliminary lab testing of Example 50 was conducted to ensure that the fluid could be used in a second trial.

It was shown that the product exhibits acceptable emulsion stability and displays a pH in the proper range.

TABLE 13

Example 50-Second Trial Parameters

| Parameter | |
|---|---|
| Machine Type | Mazak Integrex 30 CNC Machine |
| Machining Operations | Drilling and Turning |
| Metal Used | 8620 Alloy Steel |
| Sump Size | 60 Gallons |
| Initial Fluid Concentration | 5% |

The second trial carried out involved deep-hole drilling of the steel part. A 5-inch deep hole was drilled in the part with a ¼ inch diameter drill. After the first three hours, the fluid appeared to be working fine and an initial sample was pulled for lab testing.

The fluid continued to be used for the next 10 days but was later pulled out of the sump due to rancidity problems. The odor of the fluid degenerated during the period. Lab data compiled on two samples taken from the sump is provided in Table 14.

TABLE 14

Example 50- Lab Evaluation of Samples Taken from the Second Trial

| Lab Test | Initial Sample | Sample 2 weeks later |
|---|---|---|
| Brix | 3.7 | 6.8 |
| PH | 8.9 | 7.7 |
| Tram Oil | 0 | 1.0 |
| Dirt | 0 | 0 |
| Bacteria | $10^4$ | $10^7$ |
| Fungus | Yeast | Negative |
| Conductivity | 1540 | 1570 |
| Water Hardness | 100 | 250 |

Brix is a measurement of the coolant's concentration. There is a direct correlation between the brix number and coolant concentration. The data shows that bacterial concentration in Example 50 increased over time, which led to a decrease in pH (from 8.9 to 7.7). High bacterial level in the initial sample and presence of yeast are unusual. The end user might have raised the fluid concentration in response to the bacteria problem though that was never determined. A small amount of tramp oil that is found in the second sample is probably not a factor in accelerating the decomposition of Example 50.

Additional lab testing was conducted on Example 50 and is summarized in Table 15. Comparison testing was also done with a comparable high performance water based fluid.

TABLE 15

Example 50-Lab Testing

| Test | Result |
|---|---|
| Falex Pin and Vee Block - Steel: ASTMD 3233 | 2,750 lb Load |
| Tapping Torque Test - 380 Aluminum | 84% Efficiency |
| 48 Hour Product Stability | Good |
| 30 Minute Centrifuge | Product remained stable |
| Freeze/Thaw | Product remained stable |
| Dilution Stability | Some hard water instability |
| Concentrate Appearance | Clear |
| Dilution Appearance | Product milky brown |
| pH, 10% | 9.1 |

TABLE 15-continued

Example 50-Lab Testing

| Test | Result |
|---|---|
| Reserve Alkalinity | Alkalinity factor 1.51 |
| Cast Iron Chi Test | #1 Rating |
| Steel Stack Stain Test | No staining after 24 hours |
| Resistance to Galvanic Corrosion | No staining after 24 hours |
| Foam Test in Deionized Water | Foam was greater than 1,000 mls and did Not break after 5 minutes |
| 25 Grain Hard Water Test | Hard water instability |
| Recirculation Test | Product incompatible after addition of Defoamer |
| Foam Test in a highly agitated system | Foam height was 1,000 mls and broke Completely in 210 seconds. With 0.1 Defoamer, foam height was 800 mls and Broke completely in 15 seconds |

As part of the Falex Pin and Vee Block test, measurements were taken on the weight loss from the pin and vee blocks. Example 50 exhibited a lower weight loss (by 15%) than the high performance water based fluid. Failure load was the same for both Example 50 and the high performance water based fluid.

The 84% efficiency value obtained on the Tapping Torque Test is considered a good value for Example 50. Typically, the high performance water based fluid is rated in the 75% to 80% range. The reference for this test is a 200 SUS at 100° F. Naphthenic Oil, which is assigned a figure of 100%. The superior performance of Example 50 is especially notable because the metal used was aluminum.

The 48 hour stability, 30 minute centrifuge, freeze/thaw and dilution stability are all tests to gauge the stability of the fluid. Example 50 shows some instability in hard water. In the corrosion tests, Example 50 exhibited superior performance as compared to the high performance water based fluid. Especially worth mentioning are the cast iron chip test and the galvanic corrosion test. In the latter procedure, the high performance water based fluid stained aluminum while Example 50 does not.

While Example 50 exhibits some foam, it is not surprising or concerning because this result is typical of water based emulsions. Overall, Example 50 performed well in the 2 field trials and the lab evaluation work. The methyl soyate provided lubricity to enhance the performance of the fluid. Especially pleasing was the performance of Example 50 in the tapping torque lab test versus the high performance water based fluid on aluminum and the fact that the product machined aluminum. Effective lubrication of aluminum during machining operations is becoming more and more important to the industry. The reason for this trend is that the largest consumer of metalworking fluid products (the automotive industry) is turning to aluminum as a replacement for steel in order to reduce the weight of the vehicle and increase corporate average fuel economy.

Susceptibility to microbial attack has deterred industry interest in working with soybean oil and its derivatives. The metalworking industry is looking for products which can exhibit both biostability and biodegradability. The latter factor is most important during the waste treatment of the fluid and to assure that there will be no contamination of the environment. As natural products, soybean oil and its derivatives certainly will not damage the environment. But for this very same reason, soybean oil and its derivatives are not resistant to degradation from bacteria and fungus.

The following experiments were conducted to determine how a methyl soyate based formulation can be designed to withstand this type of natural decomposition while in use.

Two additional fluids (Examples 51 and 52) were prepared with more biostable components in order to better withstand microbial attack. Table 16 lists the two formulations. Test data is shown in Table 17.

TABLE 16

Formulation of Examples 51 and 52

| Component | Example 51 | Example 52 |
|---|---|---|
| Methyl Soyate | 30.0% | 7.2% |
| 100 SUS Naphthenic Oil | | 23.6% |
| Igepal CO-430 | 12.1% | 12.4% |
| Igepal CO-630 | 3.8% | 4.0% |
| Desilube 77 | 3.4% | 3.6% |
| TEA | 3.0% | 2.8% |
| MIPA | 2.6% | 2.4% |
| Glycerol Monooleate | 3.4% | 3.6% |
| Triazine | 3.0% | 2.4% |
| Sodium Omadine | 1.1% | 1.2% |
| Boric Acid Concentrate* | 8.7% | 9.6% |
| Propylene Glycol | 5.3% | 5.6% |
| Gateway CP-105 | 8.7% | 9.2% |
| Tween 80 | 1.9% | 2.0% |
| Diacid 1550 | 2.3% | 1.6% |
| Tall Oil Fatty Acid | 6.8% | 6.0% |
| 45% Potassium Hydroxide | 3.0% | 1.9% |
| Cobratec TT-50-S | 0.5% | 0.5% |
| Durad AX 38 | 0.4% | 0.4% |

*Boric acid salt of monoisopropanolamine

The following products were used: TEA (amine produced by Dow Chemical), MIPA (amine produced by Dow Chemical), Diacid 150 (fatty acid produced by Westvaco corporation), Cobratec TT-50-S (sodium tolytriazole produced by PMC Specialties Group) and Durad AX 38 (hindered phenol antioxidant produced by Great Lakes Chemical).

TABLE 17

Evaluation of Examples 51 and 52

| | Falex Pin and Vee Block Result (failure load in lbs) | Cast Iron Chip Test Result, 4% (% of the surface covered in iron) | PH, 5% |
|---|---|---|---|
| Example 51 | 4500 lbs + | 0% | 9.3 |
| Example 52 | 4500 lbs + | 0% | 9.3 |

Both fluids displayed excellent performance comparable to the chlorinated paraffin-based fluid formulated with mineral oil (Example 45).

A study was initiated using the procedure outlined in ASTM D3946-92 (Evaluating the Bioresistance of Water Soluble Metalworking Fluids) to determine how fluids based on a methyl ester of a triglyceride can be designed to withstand degradation from bacteria and fungus. The samples tested are furnished in Table 18.

TABLE 18

Samples Tested

| Sample |
|---|
| Example 50 |
| Example 51 (Methyl Soyate based with no mineral oil) |
| Example 52 (Both Methyl Soyate and mineral oil) |
| Example 53 (Biocide free version of Example 51) |
| Example 54 (Biocide free version of Example 52) |
| Example 45 (Chlorinated Soluble Oil) |

The procedure for testing bioresistance was carried out as described in the following. Microbiological inoculum were prepared from specific deteriorated metalworking fluids in the following manner.

Bacterial Inoculum: Contaminated MWF was mixed with Trypticase Soy Broth (TSB); 1:1 and was shaken for 2.5 days at 150 rpm/Room Temperature (RT).

Fungal Inoculum: Geothrichum candidum isolated from contaminated MWF was added to 200M1 TSB and was shaken at 150 rpm for 2.5 days at RT.

100 mL of the 20:1 diluted MWF samples were inoculated with 10% bacterial and 1% fungal inoculum. Samples were removed for microbiological evaluation and for pH measurement four times during the course of the test:

a. Prior to the first "weekend" shut-down.

b. Prior to the aeration initiation.

c. After the first five days of aeration.

d. After the second "weekend" shut-down.

e. And five days after the second aeration period.

Figure 2:
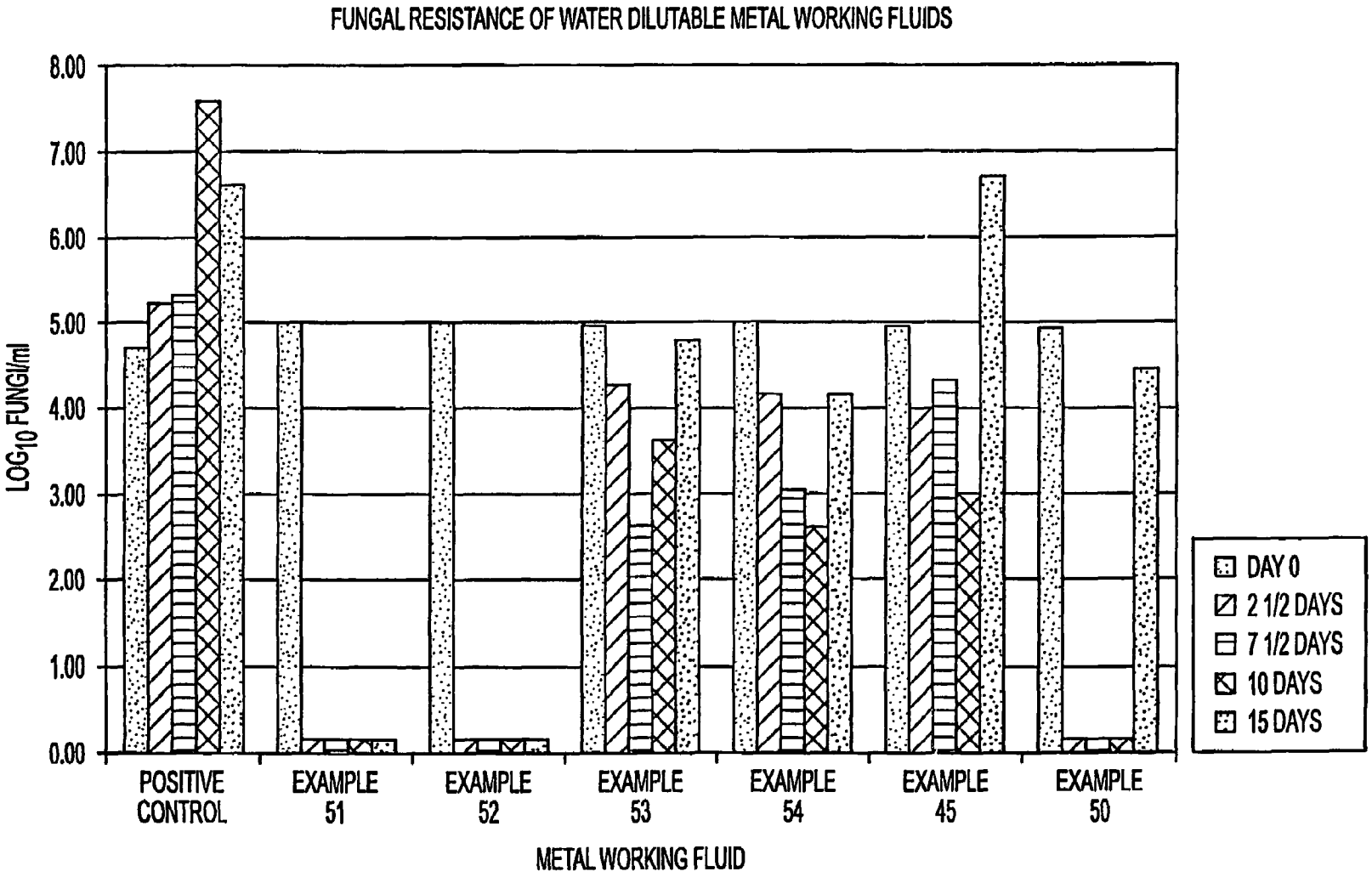
FIG. 2 demonstrates the fungal resistance of water dilutable metal working fluids, specifically for Examples 50, 51, 52, 53, 54 and 45. For each example, the first column represents 0 days, the second column represents 2.5 days, the third column represents 7.5 days, the fourth column represents 10 days, and the fifth column represents 15 days.

Droplet plating method was used for bacterial and fungal counts. L1013 pH meter was used. Table 19 & FIG. 1 shows the bacterial resistance, and Table 20 & FIG. 2 shows the fungal resistance, for the six metalworking fluids. Relative bioresistance of six MWF's were evaluated using the ASTM D3946 test.

Bacterial Resistance

The results revealed that Example 51, Example 52, Example 45 and Example 50 had high relative bioresistance against bacteria (>99.999% reduction in bacterial counts), while Example 53 and Example 54 showed no bioresistance against bacteria. (Table 19, FIG. 1).

Fungal Resistance

Example 51 and Example 52 had high fungal resistance levels (>99.999% reduction in fungal counts). Example 53, Example 54 and Example 50 had some fungal resistance, while Example 45 had no fungal resistance at all. (Table 20, FIG. 2)

pH Values pH valued did not change significantly during the 15 day time period.

Two fluids of the six, Example 51 and Example 52 had the highest bioresistance levels against both bacteria and fungi.

TABLE 19

Bacterial Resistance of Water Dilutable Metal Working Fluids Bacterial Counts/mL

| Sample Name | Day 0 Initial Count | 2½ Days 2½ Days Stagnant | 7 ½ Days 5 Days Aerated | 10 Days 2½ Days Stagnant | 15 Days 5 Days Aerated | % Reduction 15 Days |
|---|---|---|---|---|---|---|
| Positive Control | $3.0 \times 10^8$ | $1.5 \times 10^8$ | $7.0 \times 10^8$ | $1.5 \times 10^9$ | $1.1 \times 10^9$ | NA |
| Example 51 | $8.0 \times 10^7$ | <100 | <100 | <100 | <100 | >99.999 |

TABLE 19-continued

| Sample Name | Day 0 Initial Count | 2½ Days 2½ Days Stagnant | 7 ½ Days 5 Days Aerated | 10 Days 2½ Days Stagnant | 15 Days 5 Days Aerated | % Reduction 15 Days |
|---|---|---|---|---|---|---|
| | Bacterial Resistance of Water Dilutable Metal Working Fluids Bacterial Counts/mL | | | | | |
| Example 52 | $9.0 \times 10^7$ | <100 | <100 | <100 | <100 | >99.999 |
| Example 53 | $6.5 \times 10^7$ | $1.5 \times 10^5$ | $9.5 \times 10^8$ | $4.0 \times 10^7$ | $4.0 \times 10^8$ | NR |
| Example 54 | $6.0 \times 10^7$ | $6.5 \times 10^5$ | $1.0 \times 10^8$ | $5.0 \times 10^6$ | $3.0 \times 10^8$ | NR |
| Example 45 | $2.5 \times 10^7$ | <100 | <100 | <100 | <100 | >99.999 |
| Example 50 | $7.0 \times 10^7$ | <100 | <100 | $4.0 \times 10^2$ | <100 | >99.999 |

NA: Not Applicable
NR: No Reduction

TABLE 20

| Sample Name | Day 0 Initial Count | 2½ Days 2½ Days Stagnant | 7 ½ Days 5 Days Aerated | 10 Days 2½ Days Stagnant | 15 Days 5 Days Aerated | % Reduction 15 Days |
|---|---|---|---|---|---|---|
| | Bacterial Resistance of Water Dilutable Metal Working Fluids Fungal Counts/mL | | | | | |
| Positive Control | $5.0 \times 10^4$ | $1.7 \times 10^5$ | $2.2 \times 10^5$ | $3.9 \times 10^7$ | $4.0 \times 10^6$ | NA |
| Example 51 | $9.6 \times 10^4$ | <10 | <10 | <10 | <10 | >99.99 |
| Example 52 | $9.6 \times 10^4$ | <10 | <10 | <10 | <10 | >99.99 |
| Example 53 | $9.4 \times 10^4$ | $1.9 \times 10^4$ | $4.0 \times 10^2$ | $4.0 \times 10^3$ | $6.0 \times 10^4$ | 36.20 |
| Example 54 | $9.9 \times 10^4$ | $1.5 \times 10^4$ | $1.1 \times 10^3$ | $4.0 \times 10^2$ | $1.4 \times 10^4$ | 85.86 |
| Example 45 | $9.3 \times 10^4$ | $4.0 \times 10^1$ | $2.2 \times 10^4$ | $1.0 \times 10^3$ | $5.1 \times 10^5$ | NR |
| Example 50 | $9.0 \times 10^4$ | <10 | <10 | <10 | $3.0 \times 10^4$ | 66.67 |

NA: Not Applicable
NR: No Reduction

In a two week biostability test (ASTM D3946), Example 51 displayed very promising biostability properties for a methyl soyate based fluid. No bacterial or fungal growth was detected. One of the reasons for this performance is that Example 51 is formulated with a complete biocide package and does contain a boric acid based corrosion inhibitor. Testing on Example 53, a biocide free version of Example 51, did show both bacterial and fungal growth. Example 45, a conventional, chlorinated soluble oil, showed good resistance to bacteria but poor performance versus fungus.

Example 51 contains the following components: methyl soyate, MIPA, TEA and potassium salt of fatty acids, a proprietary phosphate anti-wear additive, sodium omadine, triazine, and a defoamer.

Example 50 was originally developed using a methyl soyate/mineral oil blend. It exhibited outstanding EP performance as demonstrated in several field trials. One negative comment from those who performed the field trials was that the bio-resistivity of Example 50 could stand further improvement.

In summary, both Examples 51 and 52 have displayed superior bioresistance. Example 51, based on methyl soyate, is preferred.

The embodiments illustrated and discussed in this specification are intended only to teach those skilled in the art the best way known to the inventors to make and use the invention. Nothing in this specification should be considered as limiting the scope of the present invention. The above-described embodiments of the invention may be modified or varied, and elements added or omitted, without departing from the invention, as appreciated by those skilled in the art in light of the above teachings. It is therefore to be understood that, within the scope of the claims and their equivalents, the invention may be practiced otherwise than as specifically described.

We claim:

1. A composition comprising, by weight:

from about 20% to about 95% of a methyl ester of soybean oil and at least about 3% of a phosphorus-based polar non-chlorine extreme pressure additive selected from the group consisting of amine phosphates, mixtures of organic amine salts of phosphoric and fatty acids, alkylamine or alkanolamine salts of phosphoric acid, free acid forms of complex organic phosphate esters, alkyl phosphite alkanolamine ester polymers, butylamine phosphates, long chain alkyl amine phosphates, organophosphites, propanolamine phosphates, hydrocarbon amine phosphates, triethanol, monoethanol, dibutyl, dimethyl, or monoisopropanol amine phosphates, and combinations, the composition being either (a) a working strength straight oil, (b) a soluble oil concentrate dilutable to a working strength soluble oil, or (c) a soluble oil diluted to working strength with a diluent, and the components being compatible and selected so that the composition when at working strength effectively lubricates metal parts, and imparts a four ball load wear index of at least about 40, a four ball weld point of at least about 400 kg, and/or a Falex fail load of at least about 4000 lbs.

2. The composition of claim 1, the composition containing no mineral oil or added water.

3. The composition of claim 1, wherein the composition, at working strength, has a four ball load wear index of at least about 100, and a four ball weld point of at least about 500 kg.

4. The composition of claim 1, wherein the composition, at working strength, provides a four ball load wear index of at least about 130, and a four-ball weld point of at least about 620 kg.

5. The composition of claim 1, wherein the composition, at working strength, imparts a four-ball EP weld point of at least about 800 kg.

6. The composition of claim 1, wherein the composition, at working strength, has a Falex EP (ASTM D3233) fail load of at least about 4500 lbs.

7. The composition of claim 1, wherein the composition further comprises a thickener.

8. The composition of claim 7, wherein the viscosity at 40° C. is at least about 30 cSt.

9. The composition of claim 7, wherein the thickener is selected from the group consisting of blown seed oils, blown fats, telemers derived from triglycerides, high molecular weight complex esters, polymeric ester, blown castor oil, polyalkymethacrylates, polymethacrylate copolymers, styrene butadiene rubber, ester-styrene copolymers, polyisobutylene, solutions of polyalkyl methylacrylate in highly refined oils, ethylene-propylene copolymers and combinations.

10. The composition of claim 7, wherein the thickener permits the composition to have residency time as expressed by kinematic viscosity of at least about 100 cSt at 40° C., film strength as measured by four-ball initial seizure load of at least about 120 kg, load carrying capacity as measured by four-ball load wear index of at least about 130, and compatibility between the methyl ester of soybean oil and the polar non-chlorine extreme pressure additive.

11. The composition of claim 1, wherein the composition further comprises a stabilizing coupling agent and/or surfactant.

12. The composition of claim 11, wherein the coupling agent and/or surfactant is selected from the group consisting of propylene glycol, polyethylene glycol esters, glyceryl oleates, glyceryl monooleate, sorbitan oleates, fatty alkanol amides and combinations.

13. The composition of claim 1, wherein the composition further comprises an antioxidant and/or dispersant.

14. The composition of claim 13, wherein the antioxidant and/or dispersant is selected from the group consisting of hindered phenols, hindered bis-phenolic antioxidants, liquid octylated or butylated diphenylamine, blends comprising alkylated phenol, hydroxyalkyl carboxylic ester and diphenylamine, aromatic amines, succinimides and combinations.

15. The composition of claim 1, comprising by weight from about 20% to about 95% methyl soyate, from about 3% to about 25% polar non-chlorine extreme pressure additive, up to about 50% thickener, up to about 10% coupling agent and/or surfactant, and up to about 25% antioxidant and/or dispersant.

16. The composition of claim 1, comprising by weight from about 45% to about 90% methyl ester, about 5% to about 15% polar non-chlorine extreme pressure additive, and about 5% to about 7.5% glyceryl monooleate.

17. The composition of claim 1, wherein the ratio of the methyl ester of soybean oil to the polar non-chlorine extreme pressure additive is from about 50:1 to about 1:2.

18. A method of using a composition of claim 1 for lubricating purposes comprising applying the composition to metal parts during metalworking.

19. The composition of claim 1, the composition being a soluble oil concentrate.

20. The composition of claim 19, comprising by weight from about 20% to about 90% methyl ester of soybean oil, about 3% to about 50% polar non-chlorine extreme pressure additive, and up to about 10% water.

21. The composition of claim 19, comprising by weight from about 20% to about 90% methyl ester of soybean oil, about 5% to about 50% polar non-chlorine extreme pressure additive, about 10% to about 50% emulsifiers, up to about 10% antioxidants, about 1% to about 10% biocides, about 5% to about 40% corrosion inhibitors, up to about 10% coupling agents, up to about 10% defoamers, up to about 10% water and up to about 90% mineral oil.

22. The composition of claim 19, wherein the weight ratio of the methyl ester to the polar non-chlorine extreme pressure additive is from about 1:2 to about 50:1.

23. The composition of claim 19, wherein the weight ratio of the methyl ester of soybean oil to the polar non-chlorine extreme pressure additive is from about 2:1 to about 30:1.

24. The composition of claim 19, further comprising up to about 90% (w/w) mineral oil.

25. The composition of claim 24, comprising by weight from about 20% to about 90% methyl ester, about 20% to about 35% polar non-chlorine extreme pressure additive, and about 5% to about 90% mineral oil.

26. The composition of claim 24, comprising by weight from about 20% to about 90% methyl ester of soybean oil, about 3% to about 20% polar non-chlorine extreme pressure additive, about 10% to about 50% emulsifiers, up to about 10% antioxidants, about 1% to about 10% biocides, about 5% to about 40% corrosion inhibitors, up to about 10% coupling agents, up to about 10% defoamers, up to about 10% water and up to about 90% mineral oil.

27. The composition of claim 24, comprising a mixture of the methyl ester of soybean oil, the polar non-chlorine extreme pressure additive and mineral oil in a weight ratio of about 1:2:6.

28. The composition of claim 24, comprising a mixture of the methyl ester, the polar non-chlorine extreme pressure additive and mineral oil in a weight ratio about of 9:1:0.

29. The composition of claim 19, further comprising an anti-bacterial and/or anti-fungal compound effective to prevent bacterial and fungal formation.

30. The composition of claim 1, comprising by weight from about 20% to about 90% methyl ester, about 3% to about 20% polar non-chlorine extreme pressure additive, up to about 10% water, up to about 10% coupling agents, 5% to 40% corrosion inhibitors, up to about 10% biocides, about 10% to 50% emulsifiers, up to about 6% antioxidants and up to about 5% defoamers.

31. A method of making a working strength soluble oil composition according to claim 1, comprising combining a methyl ester of soybean oil with a phosphorus-based polar extreme pressure non-chlorinated additive to form a soluble oil concentrate, and diluting the concentrate to working strength with water.

32. A working strength soluble oil according to claim 1, comprising at least about 50% (w/w) of a diluent.

33. A soluble oil composition according to claim 32, wherein the diluent is water.

34. The composition according to claim 32, comprising by weight from about 20% to about 50% methyl ester, and about 3% to about 20% polar non-chlorine extreme pressure additive, the weight ratio of methyl ester to polar non-chlorine extreme pressure additive being in the range of about 1:1 to about 50:1.

35. The composition of claim 32, further comprising a soluble oil conditioner selected from a group consisting of a coupling agent for increasing stability, a corrosion inhibitor, an emulsifier, an anti-bacterial, anti-fungal compound, and combinations.

36. The composition of claim 32, wherein the composition comprises by weight from about 20% to about 50% methyl ester, about 3% to about 20% polar non-chlorine extreme pressure additive, about 10% to about 50% emulsifiers, up to about 10% antioxidants, about 1% to about 10% biocides, about 5% to about 40% corrosion inhibitors, up to about 10% coupling agents, up to about 10% defoamers, up to about 10% water and up to about 90% mineral oil.

37. The composition of claim 1, being a working strength straight oil composition and comprising a surfactant.

38. The composition of claim 1, comprising from about 3% to about 20% of a phosphorus-based polar non-chlorine extreme pressure additive.

39. A composition comprising, by weight:

from about 20% to about 95% of a methyl ester of fatty acid and at least about 3% of a phosphorus-based polar non-chlorine extreme pressure additive selected from the group consisting of amine phosphates, mixtures of organic amine salts of phosphoric and fatty acids, alkylamine or alkanolamine salts of phosphoric acid, free acid forms of complex organic phosphate esters, alkyl phosphite alkanolamine ester polymers, butylamine phosphates, long chain alkyl amine phosphates, organophosphites, propanolamine phosphates, hydrocarbon amine phosphates, triethanol, monoethanol, dibutyl, dimethyl, or monoisopropanol amine phosphates, and combinations, the components being compatible and selected so that the composition when at working strength effectively lubricates metal parts, and imparts a four ball load wear index of at least about 40, a four ball weld point of at least about 400 kg, and/or a Falex fail load of at least about 4000 lbs, and wherein the composition is a soluble oil concentrate comprising up to about 90% (w/w) mineral oil, and wherein the methyl ester of fatty acid, the polar non-chlorine extreme pressure additive and mineral oil are in a weight ratio of about 1:2:6.

40. The composition of claim 1, wherein the phosphorus-based polar non-chlorine extreme pressure additive is one or more amine phosphates.

* * * * *